US010081887B2

(12) United States Patent
Manipatruni et al.

(10) Patent No.: US 10,081,887 B2
(45) Date of Patent: Sep. 25, 2018

(54) ELECTRICALLY FUNCTIONAL FABRIC FOR FLEXIBLE ELECTRONICS

(71) Applicant: INTEL CORPORATION, Santa Clara, CA (US)

(72) Inventors: Sasikanth Manipatruni, Hillsboro, OR (US); Shawna M. Liff, Gilbert, AZ (US); Brian S. Doyle, Portland, OR (US); Vivek K. Singh, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 462 days.

(21) Appl. No.: 13/715,012

(22) Filed: Dec. 14, 2012

(65) Prior Publication Data

US 2014/0170920 A1 Jun. 19, 2014

(51) Int. Cl.

| | |
|---|---|
| ***D03D 1/00*** | (2006.01) |
| ***D04H 13/00*** | (2006.01) |
| ***D02G 3/44*** | (2006.01) |

(52) U.S. Cl.

CPC ..... *D03D 1/0088* (2013.01); *D02G 3/441* (2013.01); *D04H 13/00* (2013.01);

(Continued)

(58) Field of Classification Search

CPC ..... G06F 1/163; G06F 1/16; G04G 21/08; G04G 17/083; G04G 9/0064; G04G 9/00; G04G 17/08; H04B 1/385; H04B 1/38; G04B 47/00; Y10T 428/24017; Y10T 428/24033; Y10T 428/24025; Y10T 428/239; Y10T 29/49002; Y10T 428/2915; Y10T 428/2913; Y10T 428/2958; Y10T 428/2969; Y10T 428/2967; Y10T 428/14; Y10T 428/2933; Y10T 428/2907; Y10T 428/294; Y10T 428/2956; Y10S 2/905; Y10S 428/922; Y10S 428/902;

(Continued)

(56) References Cited

U.S. PATENT DOCUMENTS

| | | | | |
|---|---|---|---|---|
| 3,386,476 A | | 6/1968 | Starkweather, Jr. et al. | |
| 4,457,973 A | * | 7/1984 | Matsui | A46D 1/00 428/372 |

(Continued)

FOREIGN PATENT DOCUMENTS

| | | | |
|---|---|---|---|
| WO | WO 0124596 A1 | * | 4/2001 |
| WO | 2010/067283 A1 | | 6/2010 |

OTHER PUBLICATIONS

International Search Report and Written Opinion received for Patent Application No. PCT/US2013/046868, dated Oct. 11, 2013, 14 pages.

(Continued)

*Primary Examiner* — Scott R Walshon
(74) *Attorney, Agent, or Firm* — Finch & Maloney PLLC

(57) ABSTRACT

Flexible electronically functional fabrics are described that allow for the placement of electronic functionality in flexible substrates such as traditional fabrics. The fabrics can be made using flexible electronically functional fibers or a combination of electronically functional fibers and textile fibers. Electronic devices can be incorporated into the fabric to give it full computing capabilities.

31 Claims, 10 Drawing Sheets

(52) U.S. Cl.
CPC ..... *D10B 2401/18* (2013.01); *Y10T 442/3049* (2015.04); *Y10T 442/3057* (2015.04); *Y10T 442/3976* (2015.04); *Y10T 442/603* (2015.04); *Y10T 442/696* (2015.04)

(58) Field of Classification Search
CPC ..... G01M 11/08; G01N 21/59; G01N 3/20; B32B 2307/546; B32B 2457/00; B32B 5/26; B32B 2307/302; B32B 2307/7265; B32B 2307/51; B32B 2307/724; B32B 2437/00; B32B 2307/202; B32B 5/024; B32B 7/02; B32B 2457/10; B32B 2307/20; B32B 2250/20; B32B 2307/402; A41D 31/02; A41D 2400/22; A41D 13/005; A41D 2400/60; A41D 31/0038; A41D 1/002; A41D 13/1281; A41D 27/20; A41D 27/00; A41D 27/08; A41D 1/04; A41D 13/00; A42B 3/046; F41H 1/02; D10B 2401/18; D10B 2501/00; D10B 2401/16; D10B 2501/04; D10B 2403/02431; D10B 2403/0114; D10B 2331/02; D10B 2201/02; D10B 2201/04; D10B 2401/061; D10B 2331/04; D10B 2211/04; D10B 2101/20; D10B 2211/02; D06N 3/0002; D04B 1/16; D04B 1/14; D03D 15/0077; D03D 1/0088; D03D 1/00; D03D 15/0088; D03D 1/0076; D03D 15/00; D03D 15/08; D03D 15/0066; D03D 15/0027; D03D 3/005; D03D 2700/0166; H05B 2203/014; H05B 3/347; H05B 2203/036; H02N 6/00; H01M 2/0275; H01M 4/747; H01M 2002/0205; H01M 10/0525; H01M 10/0568; H01M 4/74; H01M 10/0436; H01M 10/04; H01M 10/36; H01M 10/044; H01M 10/05; H01M 4/587; H01M 4/663; D01F 9/22; D01F 1/09; H05K 2201/029; H05K 2201/0281; D04H 13/00; D02G 3/441
USPC .... 368/282, 10, 204, 223, 47; 224/165, 167, 224/180; 65/485; 442/188, 187, 301, 442/330, 414, 243, 262, 265; 428/375, 428/364, 100, 212; 361/679.03, 730, 361/679.26, 749; 139/426 R, 421, 420 R, 139/383 R, 422, 425 R; 174/36; 439/37; 136/251, 263; 340/372.8, 572.7, 572.1; 73/146; 343/754; 264/1.28
See application file for complete search history.

(56) References Cited

U.S. PATENT DOCUMENTS 4,491,845 A * 1/1985 Rothenberg ..... 343/754
4,678,274 A * 7/1987 Fuller ..... B29B 11/14 264/1.28
4,930,863 A * 6/1990 Croitoriu ..... G02B 6/032 385/125
5,574,470 A * 11/1996 de Vall ..... G06K 7/10336 340/572.7
5,827,797 A 10/1998 Cass et al.
6,158,884 A * 12/2000 Lebby et al. ..... 368/282
6,210,771 B1 * 4/2001 Post ..... H05K 3/10 139/1 R
6,321,630 B1 11/2001 Woodall et al.
6,329,915 B1 * 12/2001 Brady ..... G06K 7/0008 340/572.1
6,329,917 B1 * 12/2001 Leonard ..... 340/572.8
6,374,643 B2 * 4/2002 Orima ..... 66/193
6,437,422 B1 8/2002 Solomon et al.
6,913,713 B2 7/2005 Chittibabu et al.
7,025,596 B2 * 4/2006 Zollo et al. ..... 439/37
7,047,800 B2 * 5/2006 Thiesen et al. ..... 73/146
7,292,758 B2 * 11/2007 Bayindir ..... C03B 37/026 257/E27.129
7,348,285 B2 * 3/2008 Dhawan ..... D02G 3/38 174/107
7,970,242 B2 6/2011 Shtein et al.
7,974,075 B2 7/2011 Peng et al.
8,003,198 B2 8/2011 Park et al.
8,351,184 B2 1/2013 Tang
8,518,537 B2 * 8/2013 Matitsine ..... C08J 9/0085 428/323
2003/0039843 A1 2/2003 Johnson et al.
2003/0135971 A1 * 7/2003 Liberman ..... B01D 67/0041 29/419.1
2003/0211797 A1 * 11/2003 Hill ..... D03D 1/0088 442/205
2003/0224155 A1 * 12/2003 Orth ..... D03D 15/00 428/223
2004/0009729 A1 * 1/2004 Hill ..... D02G 3/441 442/208
2004/0115430 A1 * 6/2004 Leonard ..... 428/364
2005/0053345 A1 * 3/2005 Bayindir ..... B29D 11/00663 385/123
2005/0275567 A1 12/2005 DePue et al.
2006/0035554 A1 * 2/2006 Glaser ..... D02G 3/441 442/301
2006/0289189 A1 * 12/2006 Aisenbrey ..... 174/36
2007/0079867 A1 * 4/2007 Chittibabu ..... D02G 3/441 136/252
2007/0128437 A1 * 6/2007 Wilderbeek et al. ..... 428/375
2008/0318002 A1 * 12/2008 Burr ..... A41D 31/0072 428/123
2009/0103859 A1 4/2009 Shtein et al.
2009/0275826 A1 11/2009 Enzerink et al.
2009/0301565 A1 * 12/2009 Curran ..... B82Y 10/00 136/263
2011/0003131 A1 * 1/2011 Matitsine ..... C08J 9/0085 428/296.4
2011/0097581 A1 * 4/2011 Deng ..... H01L 31/035281 428/374
2011/0130636 A1 6/2011 Daniel et al.
2011/0290304 A1 * 12/2011 Daniel ..... 136/251
2011/0301657 A1 12/2011 Walsh et al.
2011/0308077 A1 12/2011 Shtein et al.
2012/0019105 A1 1/2012 Krohn et al.
2012/0100355 A1 * 4/2012 Pham ..... B29C 47/884 428/212
2013/0023172 A1 * 1/2013 Lee ..... 442/179
2014/0170919 A1 6/2014 Manipatruni et al.

OTHER PUBLICATIONS

International Search Report and Written Opinion received for Patent Application No. PCT/US2013/045913, dated Oct. 7, 2013, 16 pages.
Measurement Specialities, "Piezo Film Sensors Technical Manual", Measurement Specialities, Inc., Sensor Products Division, 950 Forge Avenue, Norristown, P/N 1005663-1 REV B, Apr. 2, 1999, 89 pages.
Lyon, France, "General Introduction to the Chemistry of Dyes", 1. Principles of Colour Chemistry, vol. 99, 2010, pp. 55-67.
Dong et al., "Piezo-Phototronic Effect of CdSe Nanowires", Materials Views, Advanced Materials, 2012, pp. 1-6.
Wang et al., "Packaging Effects on Reliability of Cu/Low-k Interconnects", IEEE Transactions on Device and Materials Reliability vol. 3, Issue No. 4, Dec. 2003, pp. 119-128.
Office Action received in U.S. Appl. No. 13/714,990, dated May 21, 2015, 20 pages.
PCT International Preliminary Report on Patentability, received in PCT Application No. PCT/US2013/045913, dated Jun. 25, 2015, 9 pages.

(56) References Cited

OTHER PUBLICATIONS

PCT International Preliminary Report on Patentability, received in PCT Application No. PCT/US2013/046868, dated Jun. 25, 2015, 7 pages.
Reynolds, George T., "Piezoluminescence from a Ferroelectric Polymer and Quartz," Journal of Luminescence, vol. 75, Issue 4, pp. 295-299 (May 15, 1997).
Taiwan Office Action received in Taiwan Patent Appl. No. 102143012, dated Jan. 26, 2016, 18 pages.
Taiwan IPO Search Report received in Taiwan Patent Appl. No. 102143012, date of completion Jan. 16, 2016, 1 page.
Final Office Action received in U.S. Appl. No. 13/714,990, dated Dec. 3, 2015, 25 pages.

* cited by examiner

ELECTRICALLY FUNCTIONAL FABRIC FOR FLEXIBLE ELECTRONICS

BACKGROUND

Consumer demand for more portable and capable electronic devices has driven the development and production of smaller and more user-friendly devices. Users expect greater functionality out of even smaller devices and carry with them devices that exhibit functionality that was previously not available or only available in non-portable devices. Garments now include specialized pockets for phones, GPS devices and music players with built-in sleeves for routing cords for controllers or headsets.

Figure 1C:
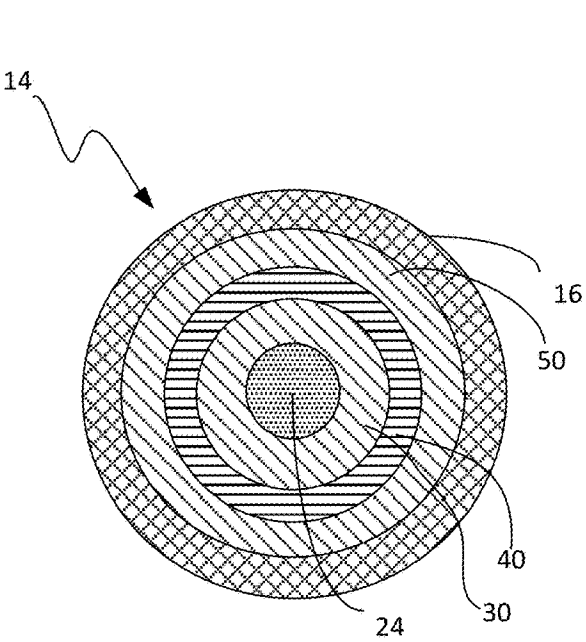
FIG. 1C provides a transverse cross sectional view of a fiber of an alternative embodiment of the invention.

As will be appreciated, the figures are not necessarily drawn to scale or intended to limit the claimed invention to the specific configurations shown. For instance, while some figures generally indicate straight lines, right angles, and smooth surfaces, an actual implementation of a transistor structure may have less than perfect straight lines, right angles, and some features may have surface topology or otherwise be non-smooth, given real world limitations of the processing equipment and techniques used. In short, the figures are provided merely to show example structures.

DETAILED DESCRIPTION

In one aspect, a fabric is provided that includes electronic and computing functionality that can be used anywhere that conventional woven and non-woven textiles can be used, for example in clothing, footwear, sporting goods, upholstery and other applications. The fabric may include flexible electrically functional fibers that impart electronic functionality to the fabric without adversely affecting the appearance and/or feel of the fabric. The flexible electrically functional fibers can include conductive materials, dielectric materials and semiconductor materials. The fabric may also include one or more electronic elements that may not be integral to the flexible electrically functional fibers but may be operationally connected via the fibers. These electronic elements can include, for example, microprocessors, emitters, receivers, antennas, electronic arrays, circuits, dies, batteries, solar cells, microphones, sensors, radiative elements, switches, lights, controllers, input devices and output devices. The flexible electrically functional fibers may be woven directly into a fabric, as is practiced with textile fibers, and may be used to place multiple electronic devices in electrical communication with each other.

As used herein, a "textile fiber" is a natural or synthetic fiber conventionally used to make woven or non-woven textiles. Textile fibers typically do not exhibit electrical functionality although they may exhibit electrical properties. Example natural materials include plant fibers such as cotton, cellulose, flax and hemp as well as animal derived fibers such as wool and silk. Example synthetic materials include polymeric and non-polymeric materials. Example polymers may be polyolefins such as polyethylene and polypropylene and halogenated polymers such as polyvinylchloride. Additional example synthetics include those materials used in fibers and fabrics such as rayon, nylon, acrylic, polyester, aramid, carbon fiber and glass fiber. The flexible electrically functional fibers may incorporate conventional natural or synthetic fibers in order to blend in with other fibers that may be used to form the bulk of the fabric. The flexible electrically functional fibers may include a single core of electronically active material(s), a bundle of independent electrical conductors, or can include coaxial layers of electronically active and inactive materials. The flexible electrically functional fibers may include specific electronic features and capabilities such as low resistance conductors, piezo resistant materials, piezo luminescent materials and capacitive materials. When incorporated into fabrics and then into textiles, these flexible electrically functional fibers can be used to connect electrical systems that can perform a variety of functions that are traditionally performed using free-standing devices. The electronically functional fabrics can be used broadly, for example, in finished goods that traditionally incorporate fabrics such as clothing, footwear, outerwear, upholstery and recreational goods such as sporting goods, camping materials and boating equipment. The fabrics can provide a variety of new electronic functionalities without adversely affecting the aesthetics or utility of the fabric.

Functional Fibers

In a first set of embodiments, flexible electrically functional fibers are provided that can provide electrical functionality to flexible substrates such as woven and non-woven fabrics. As used herein, a flexible electrically functional fiber ("functional fiber" throughout) is a man-made fiber comprising at least one electrically functional material and a layer surrounding the at least one electrically functional material. The functional fiber may include a conductor, active electronic devices and embedded structures to provide low capacitance and low resistance for high speed interconnects. The functional fiber may have a single core surrounded by an insulating cover or can include, for example, two or more coaxial layers that may be, for instance, either conductive or non-conductive. In another embodiment, the functional fiber can include a plurality of electrical elements, such as conductors, bundled together into a single fiber. In many embodiments, multiple thin layers of material can provide greater flexibility than do fewer, thicker layers of material at an equivalent carrying capacity. As illustrated in the specific embodiments shown in transverse cross-sectional views in FIGS. 1A-C, a flexible electronically functional fiber can include, for example, a single core, multiple embedded cores or a series of coaxially arranged materials. Functional fibers, such as those shown in the embodiments of FIGS. 1A-C may be easily bendable, similar to a natural or synthetic non-electrically functional fiber. For example, in some embodiments, the functional fibers described herein may exhibit a natural bending radius of less than 5 mm, less than 2 mm, less than 1 mm or less than 0.5 mm. The natural bending radius of an electrically functional fiber is the radius of the smallest cylinder that the fiber can be wrapped around without losing its intended electrical capability. The flexibility of a functional fiber can also be mechanically evaluated similarly to the way textile fibers are evaluated for flexibility. For example, in some embodiments a functional fiber can exhibit a flexibility (I/MR) greater than (more flexible than) that of a nylon fiber having a diameter equal to, or 1.1×, 1.2×, 1.5×, 2.0× or 3.0× the diameter of the functional fiber.

Figure 1B:
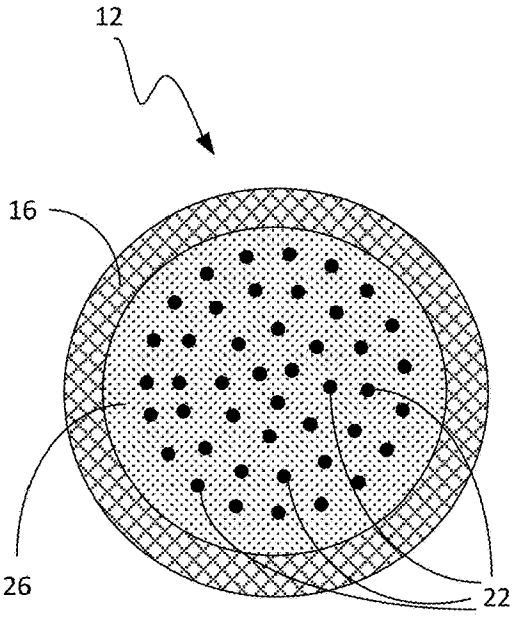
FIG. 1B provides a transverse cross sectional view of a fiber of another embodiment of the invention.
Figure 1A:
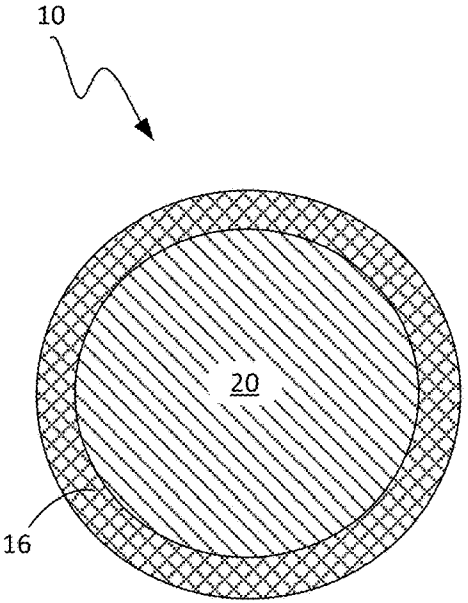
FIG. 1A provides a transverse cross sectional view of a fiber of one embodiment of the invention.

As shown in transverse cross-section in FIG. 1A, functional fiber 10 can, in some embodiments, include a single core 20 surrounded by coating layer 16. Core 20 comprises a material that may be a solid, liquid, gas or gel. Core 20 may include a conductive material in some embodiments. Core 20 may comprise materials that exhibit resistivity values of, for instance, less than $10^{-2}$ Ω·m, less than $10^{-4}$ Ω·m, less than $10^{-5}$ Ω·m, less than $10^{-6}$ Ω·m, less than $10^{-7}$ Ω·m, less than $2.0\times10^{-8}$ Ω·m or less than $1.7\times10^{-8}$ Ω·m, in accordance with some embodiments. Examples of conductive materials include metals and non-metals such as conductive polymers. In certain embodiments, core materials may exhibit ductility and flexibility and may exhibit a natural bending radius of, for example, less than 0.5 or less than 0.3 mm. Core 20 may be, for example, substantially round in cross-section and may have an average diameter of, for example, from 1 nm to 5 nm, 1 nm to 10 nm, 2 nm to 10 nm, 5 nm to 20 nm, 10 nm to 100 μm, 10 nm to 10 μm, or 100 nm to 10 μm, in some embodiments. The diameter of the core may vary along its length by a factor of >2, >5 or >10. In other embodiments, the core may have a consistent diameter along its length that does not vary by more than, for example, 50%, 20%, 10% or 1%. The conductive materials may be metallic or non-metallic and may include polymeric materials. To this end, any material having a suitable degree of conductivity for a given application can be used for core 20. Example metals include, for example, silver, copper, gold, aluminum, platinum, lead and iron. The conductive material may also be an alloy or may be a doped metal.

In another embodiment, core 20 can comprise one or more low-k flexible dielectric materials or materials having a dielectric constant on par with silicon dioxide. The dielectric materials may exhibit a dielectric constant (k) of, for example, less than 3.9, less than 3.5 or less than 3.0, in some embodiments. Dielectric materials, in some embodiments, include porous silicon dioxide and silicon dioxide doped with fluorine and/or carbon. Other example dielectric materials include polymer dielectrics including spin-on organic polymeric dielectrics such as hydrogen silsesquioxane (HSQ) and methyl silsesquioxane (MSQ), polyimide, polynorbornenes, benzocyclobutene, and PTFE. Additional example polymeric dielectrics may be made from cyclic carbosilanes.

In another embodiment, core 20 can comprise one or more high-k dielectric materials. These materials include, for instance, hafnium oxide, hafnium silicon oxide, nitride hafnium silicates, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate. The dielectric may be porous or non-porous. In general, porosity may be provisioned as a way of controlling the desired k-factor (increased porosity may be used to cause a decrease in the dielectric constant of the layer).

In another embodiment, core 20 can comprise a transducer. For example, core 20 may include a material that is piezo functional, such as a piezoelectric or piezo luminescent material. In general, a piezoelectric material translates pressure or touch into an electrical signal, and a piezo-luminescent material translates pressure or touch into electromagnetic radiation, such as a light signal. The resulting electrical/light signals can be used in various electrical and optical circuits, respectively, in accordance with some embodiments of the present invention. The piezoelectric material may be organic or inorganic and can include, for example, quartz, polyvinylidene fluoride (PVDF), apatite, aluminum nitride, potassium sodium tartrate, lead zirconate titanate, zinc oxide composite, barium titanate, lithium tantalite, lanthanum gallium silicate, bismuth ferrite, lead scandium tantalate and gallium phosphate. Examples of piezo luminescent materials include alkali halides, ferro-electric polymers and quartz materials. In some embodiments, the piezoelectric or piezo-luminescent material may be flexible. In these embodiments, materials such as polymers (e.g., PVDF), lead zirconate titanate and zinc oxide composite may be preferred.

Outermost layer 16 may be flexible, ductile and/or electrically insulative. In some embodiments layer 16 may be opaque, translucent or transparent. The layer can include a polymeric material, can consist essentially of a polymeric material or can be exclusively a polymeric material. Example polymers may include, for example, polyolefins such as polyethylene and polypropylene and halogenated polymers such as polyvinylchloride and PTFE. Additional example polymers include materials such as rayon, nylon, acrylic, polyester and aramid. Outer layer 16 may completely cover core 20 and may be substantially circular in cross-section. Layer 16 may have a wall thickness of, for example, less than 500 μm, less than 100 μm, less than 10 μm, less than 1 μm, less than 100 nm, less than 10 nm, less than 5 nm, less than 3 nm or greater than 1 nm, in some embodiments. Outer layer 16 may include natural materials to, for example, give the functional fiber the aesthetic qualities of a textile fiber. Outer layer 16 may also include additives such as pigments, dyes, antioxidants and/or UV inhibitors and may also include an additive for rendering the layer more compatible with dyes. Layer 16 may be chemically treated, for example by ozone or another oxidizer, to improve compatibility with a dye or ink. In this manner, the functional fiber can be colored using methods similar to those used for conventional fibers. If the functional fiber is to be used in a fabric comprising natural fibers such as cotton, outer layer 16 of the functional fiber can be a hydrophilic material, such as rayon, which will accept many of the dyes used to color cotton. In this way, a fabric comprising both natural fibers and functional fibers can be dyed evenly, blending the functional fibers with the natural fibers in the fabric. In other embodiments, hydrophobic materials are preferred. In yet another embodiment, oleophobic polymer coatings (e.g. fluoro-POSS containing polymers) can be used to treat the outer coating. Specific functional fiber colors can be used for identification or for aesthetic purposes when incorporated into fabrics. The outer layer 16 may protect the fiber from heat and moisture and can allow fabrics made using the fiber to be treated like a textile fiber. For example, in some embodiments, the functional fiber can be laundered and/or heat dried without damaging the functionality of the fiber.

Functional fiber 12, shown in FIG. 1B, provides a transverse cross sectional view of one embodiment of a composite functional fiber in which a plurality of electrically functional fibers 22 are embedded in embedding material 26. The functional fibers 22 and embedding material 26 can in turn be surrounded by coating material 16. In specific embodiments, functional fibers 22 may comprise 1-10%, 5-10%, 5-20%, 5-30%, 5-50% or 5-75% of the volume contained inside outer layer 16. In other embodiments, embedding material 26 can comprise 10-20%, 10-50%, 10-75%, 20-90%, 20-95% or 20-99% of the volume contained inside outer layer 16. There may be many individual electronically functional fibers 22 within single functional fiber 12. For example, some embodiments may include more than two, more than five, more than 10, more than 100 or more than 1000 individual fibers 22 in single composite fiber 12. Individual fibers 22 may be thin, allowing many functional fibers to be packaged in a single composite functional fiber. For example, functional fibers 22 can have an average diameter of less than 1 μm, less than 100 nm, less than 50 nm, less than 20 nm, less than 10 nm or less than 5 nm. Individual functional fibers 22 may be made out of any suitable material including the materials described with reference to core 20, above. Functional fibers 22 may vary in diameter both within a functional fiber and between functional fibers. For example the diameter of one functional fiber 22 may have a diameter that is 1×, 2×, 3×, 10× or greater than 10× the diameter of another functional fiber 22.

Embedding material 26 may be any material that can support individual fibers 22 inside of outer layer 10. In different embodiments, embedding material may include a solid, a liquid, a gel or a gas and can be conductive or nonconductive. In some embodiments, embedding material 26 can comprise one or more of the materials used for core 20 or for outer layer 16. For example, embedding material 26 may be a high k or low k dielectric material. In some embodiments, the dielectric material may be an easily flexed material that can retain most of its dielectric capabilities upon flexing. For instance, in some embodiments, the dielectric material can be a flexible polymer, a gel or a foam and may be porous or nonporous. Embedding material 26 may be of low density, for example, less than 0.5 g/cc, less than 0.2 g/cc or less than 0.1 g/cc. In one embodiment, embedding material 26 can comprise an aerogel, such as a silica aerogel. Outer layer 16 may be of any suitable material including those described with reference to coating layer 16 in FIG. 1A.

FIG. 1C provides a transverse cross sectional view of an embodiment of a coaxial functional fiber. In the embodiment shown, a core 24 is surrounded by two conductive layers 30 and 50, dielectric layer 40 and outer layer 16. Various embodiments can include two, three, four, five, six or more layers. Core 24 may be made from conductive or nonconductive material and in the embodiment shown is nonconductive. The core can be made from a textile fiber. In some embodiments the core may be void, providing a hollow core functional fiber. In other embodiments, the core may comprise or consist essentially of a fluid such as a liquid or gas at room temperature. A liquid core may be efficient at absorbing and transporting heat and may be a substance exhibiting a high specific heat, such as greater than 0.5 cal/g° C., greater than 0.80 cal/g° C., greater than 0.90 cal/g° C. or greater than 0.95 cal/g° C. Examples of appropriate liquids include aqueous compositions such as water and water/glycol mixtures. Non-aqueous examples include, for example, low toxicity, high flash point materials such as glycols, and vegetable oils.

In this embodiment and others described throughout this disclosure, conductive materials may be applied as a film using methods known for applying conductive films to substrates. If a polymer, the conductive material may include a dopant or additive such as iodine or carbon black. In some embodiments the conductive layer may be a translucent or transparent material. These materials include, for example, transparent conductive oxides (TCO) such as tin-doped indium-oxide, aluminum-doped zinc-oxide (AZO) and indium-doped cadmium-oxide. Transparent or translucent polymeric materials include, for example, polymers containing thiophenes such as poly(3,4-ethylenedioxythiophene) (PEDOT), PEDOT with poly(styrene sulfonate) (PSS) and poly(4,4-dioctylcyclopentadithiophene).

In transverse cross-section, conductive layers 30 and 50 may be substantially circular and may have an average diameter of from 10 nm to 100 μm, 100 nm to 10 μm, or 100 nm to 1 μm, in some embodiments. The ratio of the diameters of first conductive layer 30 or second conductive layer 50 to core 20 may be, for example, greater than 1.5:1, greater than or equal to 3:1, greater than or equal to 5:1, greater than or equal to 10:1, greater than or equal to 50:1 or less than 100:1. The ratio of the diameter of second conductive layer 50 to that of first conductive layer 30 can be, for example, greater than or equal to 1.5:1, greater than or equal to 2:1, greater than or equal to 3:1, greater than or equal to 10:1, greater than or equal to 50:1 or less than 100:1. The wall thickness of each of conductive layers 30 and 50 may be, for example, less than 100 μm, less than 10 μm, less than 1 μm, less than 100 nm, less than 10 nm or greater than 1 nm.

The inner insulative layer 40 can include, for example, a low-k flexible dielectric material, or any other suitable dielectric material capable of providing the desired flexibility and insulative effect including high-k dielectrics as well as dielectric materials having a dielectric constant on par with silicon dioxide. The materials may exhibit a dielectric constant (k) of, for example, less than 3.9, less than 3.5 or less than 3.0, in some embodiments. The dielectric layer 40 may be substantially circular in cross-section and the ratio of the diameter of the layer compared to first conductive layer may be less than or equal to 3:1, less than or equal to 2:1, less than or equal to 1.5:1, less than or equal to 1.2:1 and may be greater than or equal to 1.01:1. Dielectric layer 40 can have a wall thickness of, for example, less than 100 μm, less than 10 μm, less than 1 μm, less than 100 nm, less than 10 nm, less than 5 nm or greater than or equal to 1 nm. Dielectric layer 40 can be made from materials including porous silicon dioxide and silicon dioxide doped with fluorine and/or carbon. Other example dielectric materials include polymer dielectrics including spin-on organic polymeric dielectrics such as hydrogen silsesquioxane (HSQ) and methyl silsesquioxane (MSQ), polyimide, polynorbornenes, benzocyclobutene, and PTFE. Additional example polymeric dielectrics may be made from cyclic carbosilanes. Examples of high-k dielectric materials include, for instance, hafnium oxide, hafnium silicon oxide, nitride hafnium silicates, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate. The dielectric may be porous or non-porous. In general, porosity may be provisioned as a way of controlling the desired k-factor (increased porosity may be used to cause a decrease in the dielectric constant of the layer).

In many embodiments, the functional fibers described herein can be spun into yarn and/or thread using spinning techniques that are available to those in the fabric and textile arts. Functional fibers may be spun with other functional fibers or may be spun with textile fibers to form a hybrid thread comprising both functional threads and textile fibers. These hybrid threads may include one, two, three, four, five or more functional fibers. In some embodiments, hybrid threads may have a functional fiber to textile fiber ratio, on a fiber to fiber basis, of less than, greater than, or equal to 1:10, 1:5, 1:2, 1:1, 2:1, 5:1 or 10:1.

Figure 2A:
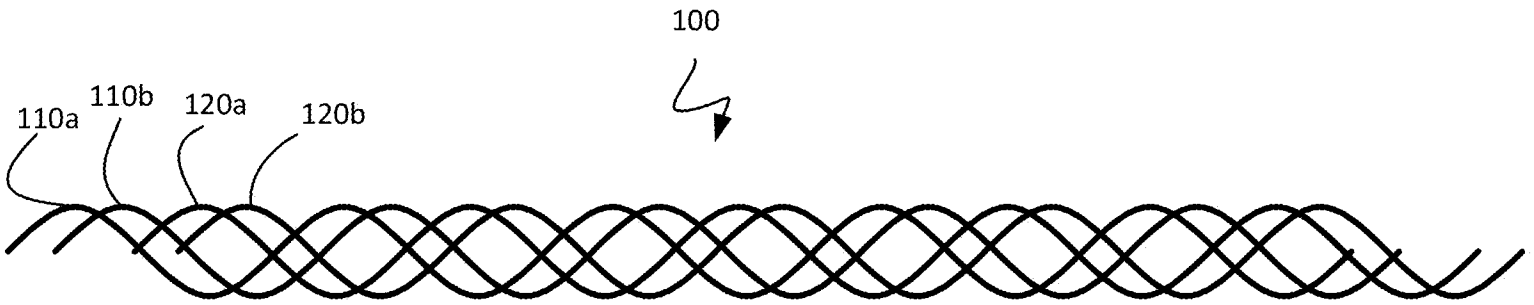
FIG. 2A illustrates an embodiment of the invention including two twisted pairs of fibers.
Figure 2B:
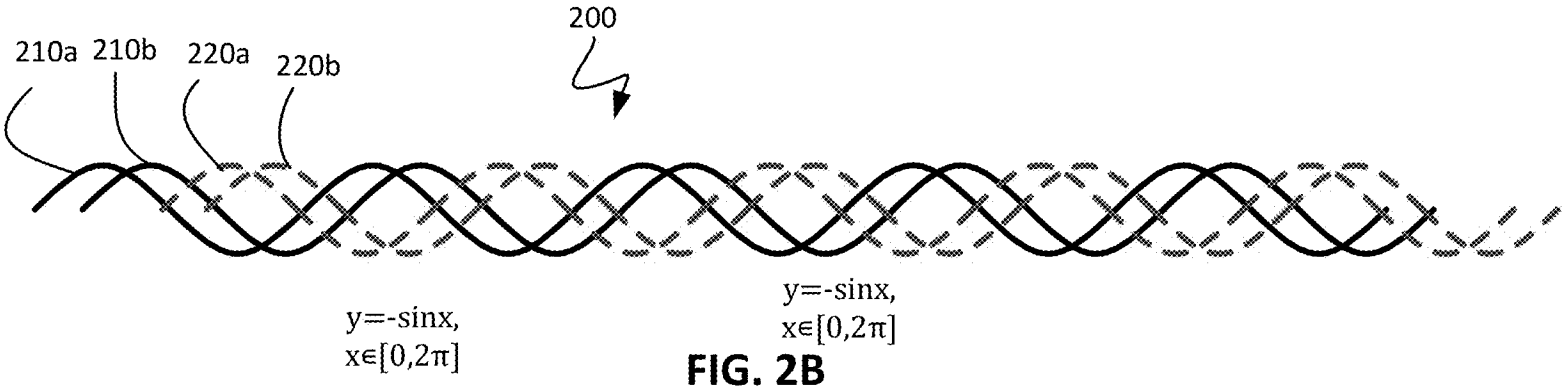
FIG. 2B illustrates an embodiment of the invention including a twisted pair of functional fibers and a twisted pair of textile fibers.

As illustrated in FIG. 2A, the functional fibers described herein can be used in twisted pair configurations, in accordance with some embodiments. The use of twisted pair configurations can help achieve low resistance while maintaining the high flexibility of the composite thread 100. Twisted pair configurations may also be used to reduce crosstalk of signals traveling within the functional fibers. As used herein, a composite thread is a thread that includes more than one type of fiber. Although the illustration shows two twisted pairs 110*a*, 110*b* and 120*a*, 120*b*, any number of twisted pairs can be used together. For example, composite thread 100 may include one, two, three, four, five, six or more twisted pairs. FIG. 2B illustrates an embodiment of a hybrid composite thread 200. Hybrid composite thread 200 can include electrically functional pair 210*a* and 210*b* as well as textile fiber pair 220*a* and 220*b*. The ratio of electrically functional fibers to conventional fibers can vary and may depend on, for example, the amount of functionality or the amount of natural feel, look and texture that is desired for the hybrid thread 200. In other embodiments, short non-functional fibers such as cotton, wool or polyester threads may be mixed into the composite threads of FIGS. 2A and 2B. These short fibers may be positioned substantially transversely to the axis of composite thread 100 or 200. The short fibers may be held in place by retaining them between the individual functional fibers that make a twisted pair or between the pairs themselves. These transverse fibers may extend outwardly 2, 3, 5 or 10 times the diameter of the thread or fiber. Under the microscope, these threads may appear as caterpillars or "pipe cleaners" with the ends of the non-functional fibers extending radially from the axis of thread 100 or thread 200. This configuration can provide for a unique textural or aesthetic appearance without significantly stiffening the hybrid composite thread.

Functional Fiber Applications

Flexible functional fibers can be provided with different types of electronically functional capabilities. In one set of embodiments, the fibers can serve as connective wires and can serve in any way that conventional wires and traces do. For example, functional fibers can be used to provide electrical communication between two devices, a device and a power source, a device and an input source, a device and an output source or a device and a signal source. A single functional fiber can include, for example, 1, 2, 3, 4, 5, 10, greater than 10, greater than 100 or greater than 1000 independent conductors.

Functional fibers can also incorporate electrical devices integrally into the fiber. For example, functional fibers can include memory devices, input devices and output devices. These devices can include, in some embodiments, transducers such as piezoelectric devices. For example, dielectric layer 40 as shown in FIG. 1C can be replaced, or partially replaced, with a piezo electric material to give piezo electric functionality to the fiber. A piezo functional layer may be, for example, a piezoelectric material or a piezo-luminescent material and can be embedded in the capacitance between conductive layers 30 and 50, for example. Functional fibers including piezo functional materials as described herein may be woven into fabrics and formed into twisted pairs as shown in FIGS. 2A and 2B, in some embodiments. Suitable piezo active materials that can be incorporated into a functional fiber include, for example, those described above in reference to core 20.

Piezo functional materials can provide functional fibers with functionality that allows the functional fibers to respond to pressure. For example, a piezo functional fiber woven into a shirt can act as a switch when the portion of the fabric of the shirt that includes the piezo functional portion is pressed or bent. By monitoring resistance between ends of the electrically functional fiber one is able to detect when a piezoelectric material in series with the fiber has been activated. Resistance may increase or decrease as a result, depending on the type of piezo active material that is used. If more than one piezoelectric device in series in a fiber is activated, the change in resistance will be proportionally greater. In this manner, one can detect the difference between pressure over a small portion of the fiber (or fabric) and pressure over a larger portion of the fiber. For instance, the difference between a finger pushing on a fiber and a hand pushing on the same fiber could be detected by a greater change in resistance due to pressure contact on a greater number of piezoelectric devices. The active portion of the fabric may be identified by color or other indicia but in some embodiments is not visually identifiable or otherwise highlighted and can blend in with the rest of the fabric.

Functional fibers including piezo functional materials may be of consistent diameter throughout their length, in some embodiments. The portion of a functional fiber including a piezo functional material can have a same or similar diameter as the portion of the functional fiber comprising an interconnect. The length of a piezo active portion of a functional fiber may be selected to elicit a detectable response when activated. In some cases, the length of the piezo active portion may, for example, fall within a range having a lower limit of 10 nm, 100 nm, 1 μm, 10 μm, 100 μm or 1 mm and an upper limit of 1 μm, 1 mm, 1 cm or 10 cm. In embodiments where the piezo active portion is not flexible, the portion may be shorter than in other applications. For instance, the piezo active portion may be less than 1 mm, less than 100 μm, less than 10 μm, or less than 1 μm in length. Multiple piezo active materials may be formed in a functional fiber at consistent and/or varying intervals along the fiber. For example, a 1 mm length of piezo functional material may be formed in a functional fiber at 1 cm intervals along the fiber. Regular intervals can be used to assure that when pressure is applied anywhere along the functional fiber by, for example, a human thumb or finger(s) or hand, at least one piezo functional portion will be activated.

In some cases, a piezo functional material may not spontaneously return to its initial state after being activated, thereby effectively providing a memory cell. The value of the cell can be read out using conductive interconnects, and can be based, for instance, on the resistive state of the piezo functional material (e.g., a high resistance value can be a logical 1, and a low resistance can be a logical 0, assuming a binary system). To re-set these materials, a charge or current can be applied to the functional fiber to re-set or re-activate the piezo components. In this manner, the functional fiber can be effectively programmed and unprogrammed repeatedly. A functional fiber including a piezo luminescent device can be used in a similar fashion, except that the output signal is light. In embodiments where the output signal is light, the light can be in the visible range, the infrared range or the UV range, for example.

In addition, a functional fiber including a piezo luminescent device could be used in clothing to inform the user that a desired user control input to electronics embedded within the fabric has been received or that a sufficient charge is available to power such embedded electronics or to store a user input in an optical-based memory cell of the embedded electronics has received data. Numerous other applications will be apparent in light of this disclosure. For example, a functional fiber including a piezo luminescent device could be used on and/or in an automobile and/or test dummy to indicate where impact points occur during a test crash. The luminescent device could then be re-set for one or more subsequent tests. Other lighting devices can be used and may include luminescent, electroluminescent and electrophosphorescent devices, such as, for example, light emitting diodes (LEDs). Optical circuits such as memories and sensors may be implemented with such fabric-embedded circuits, for example.

Figure 8:
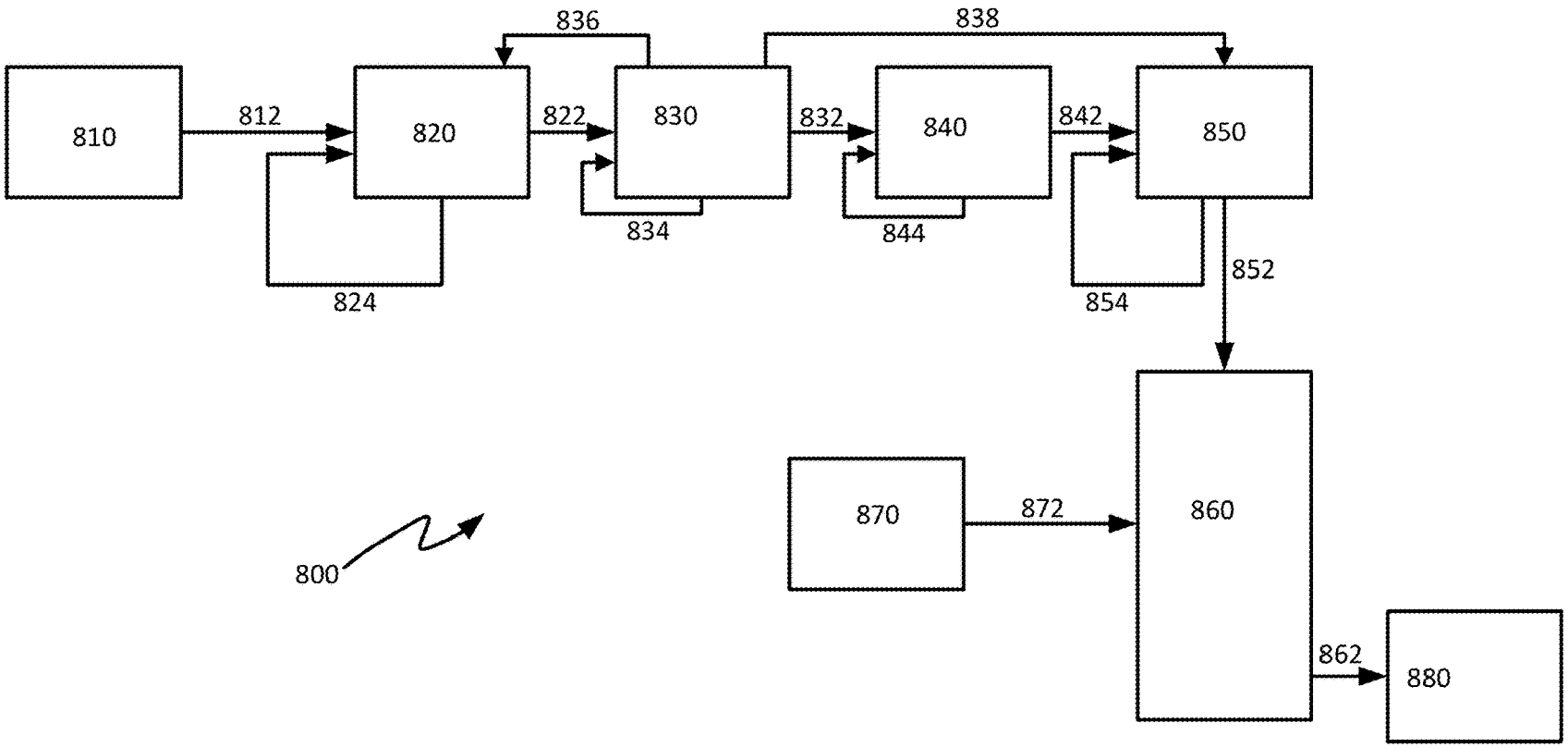
FIG. 8 provides a flow chart explaining a series of embodiments of flexible electrically functional fiber production methods.

As used here, activating a device, such as a device integral to a functional fiber, may include, for example, storing a potential in the device, biasing a junction of the device or causing a transducing effect in the device (e.g., converting signal to light, converting signal to pressure, converting signal to vibration, converting signal to movement, etc). To this end, devices can be, for example, a capacitor, a variable resistor, a piezo-electric device, a piezo-luminescent device, an LED, a transistor or other active device having one or more active junctions, a transducer or sensor (e.g., electro-optical transducer, piezo-based transducer, MEMS-based sensor), or any other electronic device that can be formed in the context of a functional fiber using a stepped fabrication process such as the example one described with reference to FIG. 8.

Fabrics Incorporating Functional Fibers

Figure 3:
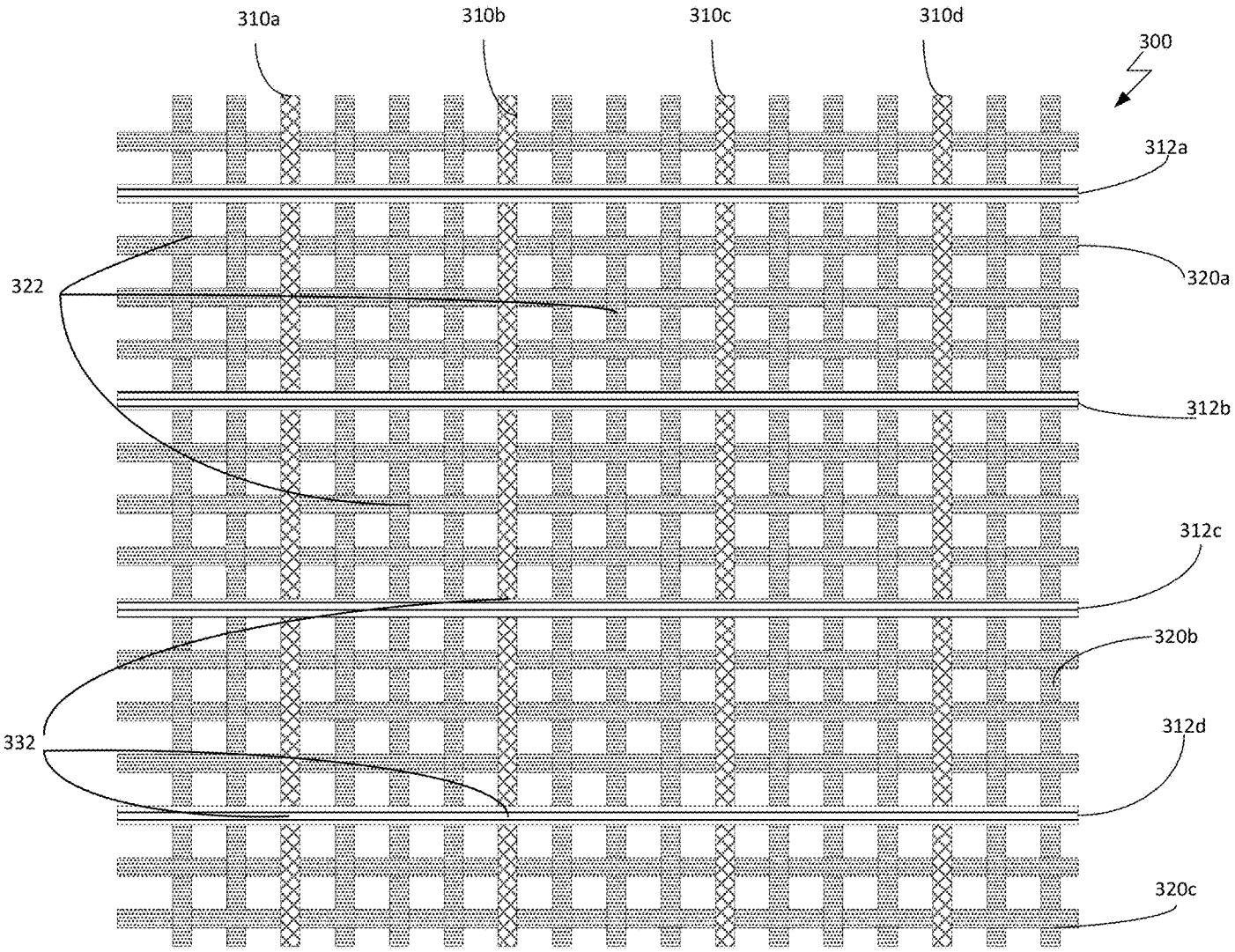
FIG. 3 provides a plan view of one embodiment of the invention including a functional grid and a woven fabric.

In one aspect, the electrically functional fibers described herein can be formed into two dimensional grids that can be incorporated into flexible fabrics. The flexibility of a functional fabric can be measured in a way (natural bending radius) similar to that used to measure the flexibility of fibers. For instance, a functional fabric can be wrapped around a cylinder of a specific radius and the functionality of the fabric tested. In some embodiments, the flexible fabrics described herein exhibit a natural bending radius of less than or equal to 10 cm, less than or equal to 5 cm, less than or equal to 2 cm, less than or equal to 1 cm, less than or equal to 5 mm, less than or equal to 2 mm, less than or equal to 1 mm or less than or equal to 0.5 mm. FIG. 3 illustrates one embodiment of a hybrid fabric incorporating both functional fibers and textile fibers. As shown, an electrically functional grid 332 can comprise horizontal functional fibers 312*a-d* and vertically oriented functional fibers 310*a-d*. Each of the functional fibers may be the same or different. Textile fibers 320*a-c* and others like them form woven non-electrically functional fabric 322. Woven fabric 322 can be made from textile fibers, and in some cases the textile fibers may be homogeneous or heterogeneous mixtures of two or more types of textile fibers. As shown in FIG. 3, the functional fibers are proportionally spaced, but in alternative embodiments spacing can take a different pattern or can be random. Functional fibers can also be oriented in a different direction, for example, diagonally. Functional grid 332 can be placed on top of a woven fabric 322, as illustrated, to produce functional fabric 300. Additional functional grids may, in some cases be stacked on top of functional grid 332 or may be added below woven fabric 322. In some embodiments, functional grid 332 may be adhered to woven fabric 322 by, for example, an adhesive, sewing, thermal compression bonding or by lamination.

Figure 4:
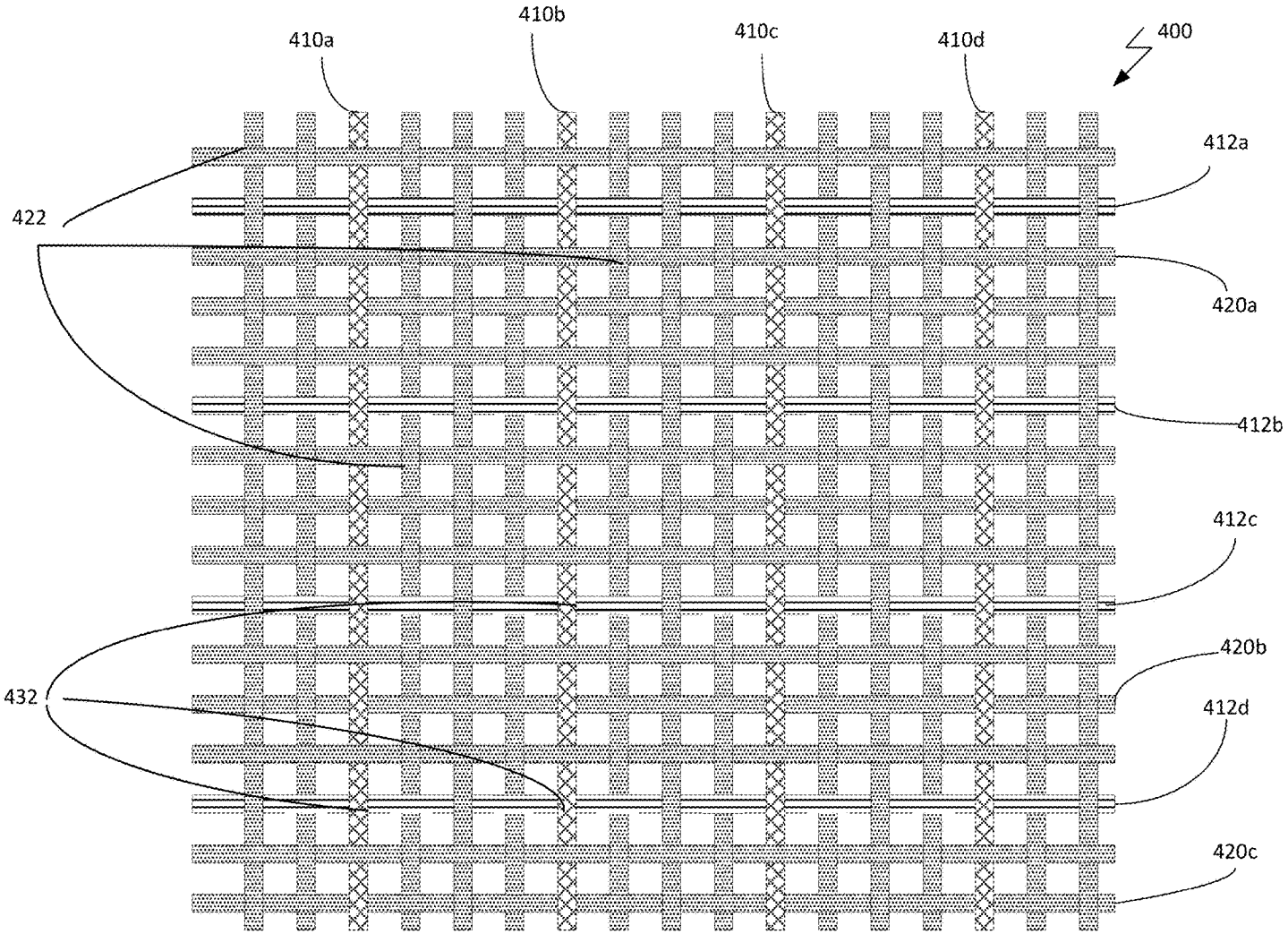
FIG. 4 provides a plan view of another embodiment of the invention where functional fibers are woven into a fabric.

FIG. 4 illustrates an embodiment similar to that shown in FIG. 3 except that functional fibers 410*a-d* and 412*a-d* are woven integrally into the fabric along with textile fibers 420*a-c* and others like them. In this embodiment, functional grid 432 and non-electrically functional grid 422 are woven together to produce electrically functional fabric 400. The different functional fibers may perform different functions, and one or more of the functional fibers may incorporate, for example, an electronic device, such as a piezoelectric device. In this embodiment, the functional fibers can be temporarily or permanently joined to the non-functional textile fibers without an adhesive or other means of affixing the two grids together. Thus, the fabric may be devoid of adhesives or fasteners. Functional fibers 410*a-d* and 412*a-d* may be, for example, sized, textured and/or colored to mimic textile fibers in the fabric. In this manner, the electronic functionality of the fabric may be hidden or not apparent. The functional fibers described herein can be woven into fabrics having high thread counts, leading to wearable, flexible fabrics that possess electronic capabilities. For instance, the fabrics, in some embodiments, may have a thread count per inch (warp plus weft) of greater than 30, greater than 50, greater than 100, greater than 150 or greater than 200.

Numerous weave patterns can be used for both functional and non-functional fabrics, and the claimed invention is not intended to be limited to any particular one. For example, the fabrics can be woven in twill, plain or satin patterns. Any number of non-functional fibers, such as textile fibers, may be woven in with the functional fibers to form a fabric. Thus, the fabric, by mass or by surface area, may be 100% functional fiber, 50 to 100% functional fiber, 20 to 50% functional fiber, 10 to 20% functional fiber, 5 to 20% functional fiber, 1 to 10% percent functional fiber, 1 to 5% functional fiber, 0.1 to 5% functional fiber, 0.1 to 1% functional fiber or from greater than 0 to 0.1% functional fiber. Similarly, the fabric may contain, greater than 50%, greater than 75%, greater than 90%, greater than 95%, greater than 99% or greater than 99.9% textile fiber, by weight or by surface area.

Figure 5:
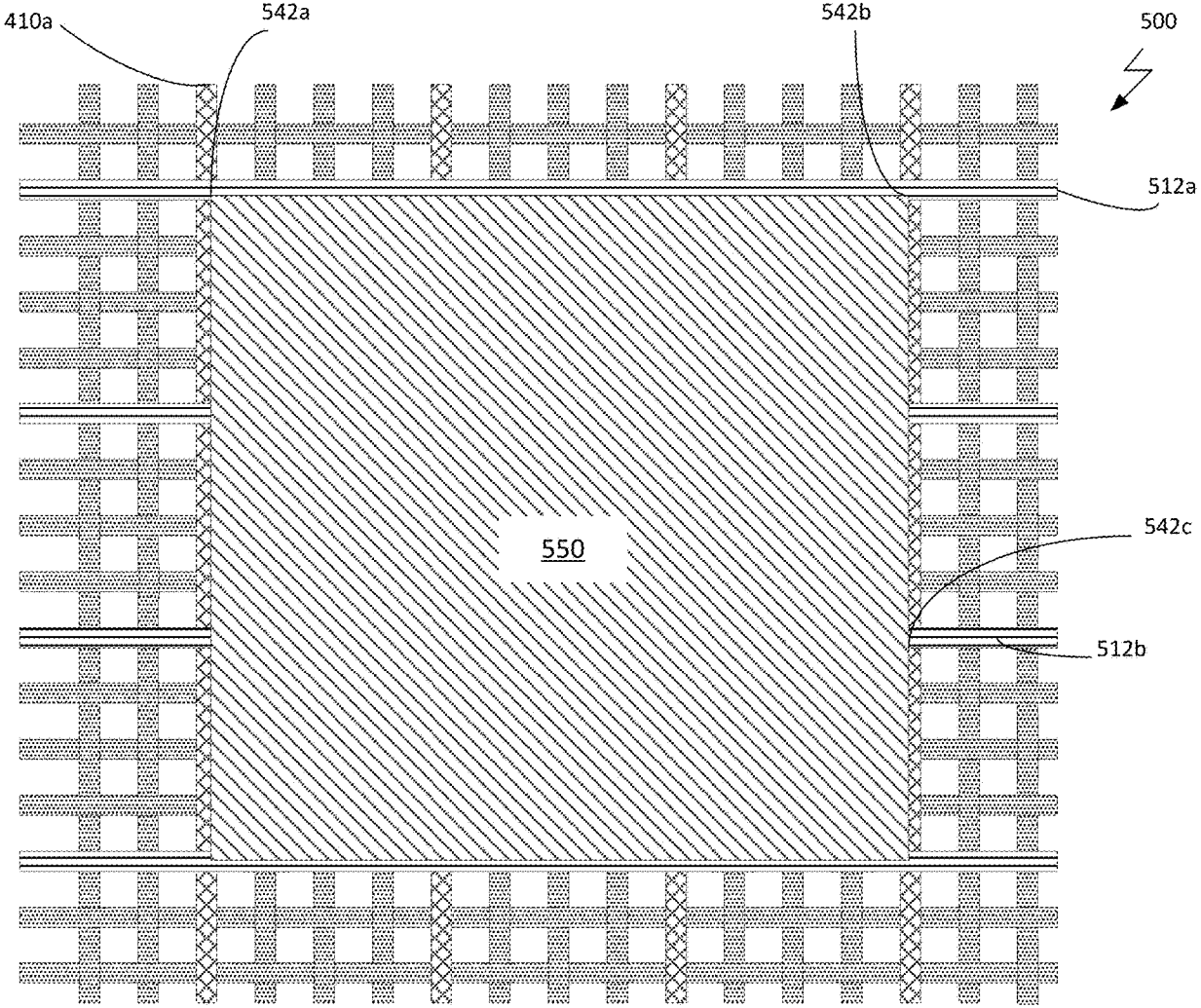
FIG. 5 provides a plan view of an embodiment of the invention where an electronic element is operationally connected to a functional fabric.

FIG. 5 illustrates an embodiment where an electronic device that is not an integral part of a functional fiber is incorporated into a fabric. Device 550 represents an active electronic element such as, for example, a computing element, a sensing element, a communications element, a photovoltaic cell, a solar cell or a data storage element. For instance, device 550 can be, in some embodiments, a microprocessor. Device 550 can be produced using known techniques and can then be integrated into functional fabric 500 by forming electrical connections at, for example, contact points 542*a-c*. At these contact points, device 550 can be in electrical communication with the functional fibers in the fabric. For example, contact 542*a* connects device 550 with functional fiber 410*a*; contact 542*b* connects device 550 with functional fiber 512*a*; and contact 542*c* connects device 550 with functional fiber 512*b*. These contact points can also be used to secure device 550 to functional fabric 500. In alternative embodiments, device 550 can be electrically connected to one, two, three, four, five or more functional fibers. Contact points need not be exclusively along the edge of device 550, but may, for example, be on the bottom or top surface of device 550. Device 550 may also be optionally electrically connected, via wire or wirelessly, to connectors and devices that do not form part of the functional fabric.

Figure 6:
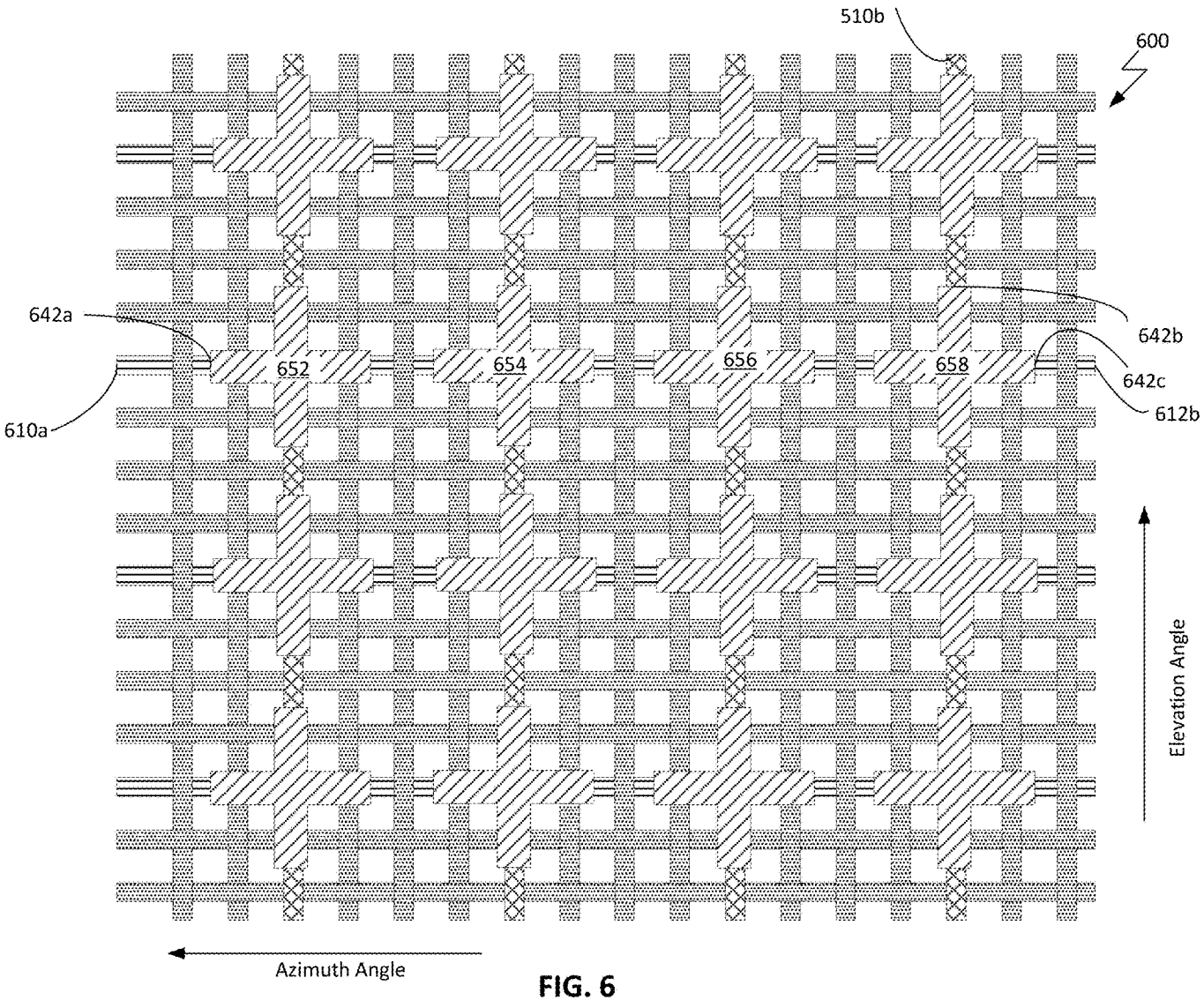
FIG. 6 provides a plan view of an embodiment of the invention that includes an array of radiative elements integrated with a functional fabric.

FIG. 6 illustrates a radiative array integrated with a functional fabric to make a flexible planar phased array 600 that can be used, for example, for near and far field communications. The underlying flexible functional fabric can be similar to those shown, for example, in FIGS. 4 and 5. Flexible radiative array 600 can be integrated into textiles and used, for example, in clothing, such as uniforms. The array shown includes 16 radiative elements including radiative elements 652, 654, 656 and 658. In the embodiment shown, radiative element 652 can connect electrically and physically to functional fiber 610*a* at contact point 642*a*. Similarly, as shown in this embodiment, radiative element 658 contacts functional fiber 510*b* at contact point 642*b* and contacts functional fiber 612*b* at contact point 642*c*. Through integration with the functional fabric, each of the radiative elements can be independently controlled to provide multi-directional radiation patterns or to detect the origin of incoming electromagnetic radiation. Radiative array 600 can be configured to be a transmitter of electromagnetic radiation, a receiver of electromagnetic radiation, or both. The direction of both azimuth angle and elevation angle for the illustrated embodiment are provided in the figure. As presented in this embodiment, the radiative array can be oriented substantially vertically, with the flexible functional fabric attached to, or integral to, for example, the front or back of a shirt or jacket, the surface of which lies substantially in a vertical plane when the wearer is standing. In other applications of course, the azimuth and elevation angles could be adjusted for the specific orientation of the array. These functional fibers can be in communication with other components of a system, such as, a microprocessor, a receiver and/or a transmitter. Flexible radiative array 600 can, in some embodiments, include insulating shielding to eliminate or reduce the effect of unwanted body conductance. For example, if worn as part of clothing, the insulating shielding can be fabricated into the clothing and can reduce or eliminate the effect of body conductance. Insulating shielding can also be directly incorporated into the flexible array. In some embodiments, the insulating shielding is also flexible and may be an insulating plastic.

Figure 7:
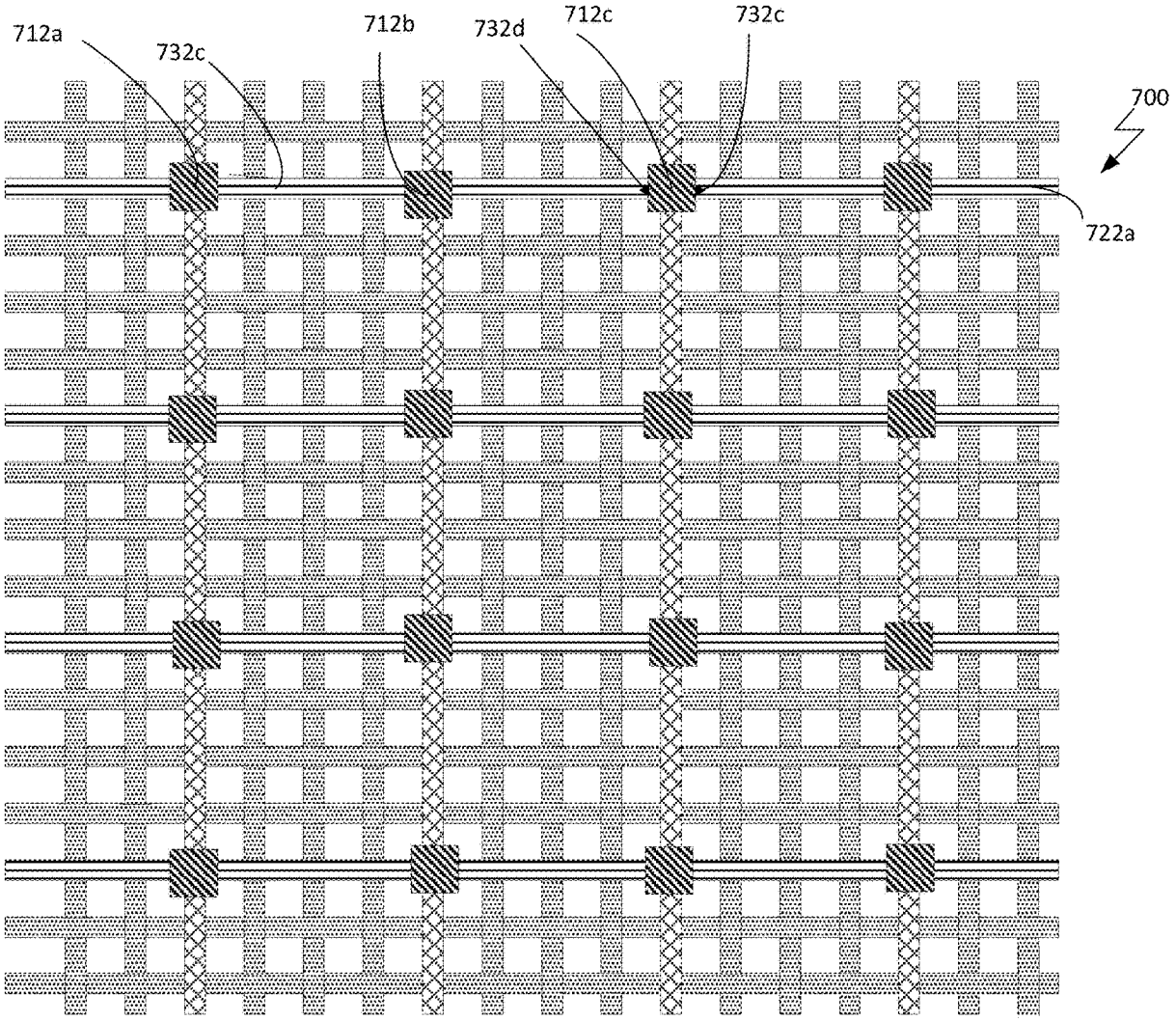
FIG. 7 provides a plan view of an embodiment of the invention that includes an array of computing elements operationally coupled to a woven functional fabric.

FIG. 7 provides an illustration of an embodiment of a flexible functional fabric combined with one or more computing elements to form a flexible fabric computing device 700. In this embodiment, device 700 includes sixteen computing elements including dies 712*a-c*. In this embodiment, dies 712*a-c* can be organic or inorganic electronic elements. Organic electronic elements may include those made of, for example, conductive polymers while inorganic electronic elements include those made of silicon and metals such as copper. In many embodiments, dies 712*a-c*, or other computing elements, can be sized so that they can be hidden, or difficult to see, in a fabric. For instance, small computing elements can be affixed between layers of fabric or can be arranged in a pattern that matches a color pattern on the fabric. As the dies (or alternative computing elements) may be substantially inflexible, the use of larger materials might, in some cases, interfere with the flexibility of the functional fabric. On the contrary, dies of a very small size do not need to bend in order for the functional fabric to be substantially flexible (e.g., natural bending radius of less than 5 cm). In some embodiments the computing elements may be substantially planar, may be square and/or may have a surface area of less than 50 $mm^2$, less than 10 $mm^2$, less than 5 $mm^2$, less than 2 $mm^2$ or less than or equal to 1 $mm^2$. Computing elements of a larger size may be used in fabrics that require little or no flexibility while smaller computing elements can be used in fabrics that require extensive flexibility. Some garments, for example, may include computing elements of various sizes, and the larger elements may be used in those areas that are typically more planar, such as on the wearer's back or front, while smaller elements can be used in more curved areas, such as sleeves, shoulders and collars. In some embodiments, the computing elements may be transparent or translucent.

In the embodiment shown in FIG. 7, the functional fibers such as 722*a* can include protrusions or sunken features that provide for interconnect areas for mating with complementary features on dies 712*a-c*. These protrusions or sunken features may be in contact with any layer in the fiber, for example, core 20 or any of layers 30, 40 or 50 as shown in the embodiment portrayed in FIG. 1*c*. These features may also be isolated from any one or more of these layers. In the embodiment portrayed in FIG. 7, protrusions 732*c* and 732*d* on functional fiber 722*a* are mated and form an electrical interconnect with complementary indents on die 712*c*. These interconnects can also serve to physically hold die 712*c* onto the fabric substrate. In other embodiments, the die may be secured onto the fabric substrate by, for example, thermal compression bonding, self-alignment such as by soldering, or alignment with selective surfaces followed by thermal bonding. In some cases, the dies may be bonded to the fabric well enough that the fabric (clothing, for example) can be laundered using conventional laundering practices.

In one set of embodiments, the functional fabric of FIG. 7 can include light emitting or luminescent fibers that can function as display elements when controlled via small computing elements such as dies 712*a-c*. For example, in one embodiment, functional fiber 722*a* can include LED 732 at a portion of the fiber that is positioned between dies 712*a* and 712*b*. Either die 712*a* or 712*b* can be instructed to activate LED 732. In this manner, LED 732, plus any number of optional additional light sources on the fabric, can light in specific patterns, such as letters or numbers, for example. This computer controlled output device can thus form an image that can then be interpreted by the wearer of a garment that incorporates the functional fabric. The same or a different image may also be seen by observers not wearing the garment.

In another embodiment, the functional fabric can include a plurality of micro processing elements that can be coordinated in software to achieve parallel processing in a flexible, functional fabric. The microprocessors may be interconnected via functional fibers that are integral to the functional fabric. Power can be provided to the microprocessor by, for example, a power source such as one or more battery cells and or one or more solar panels operatively coupled to the fabric.

Manufacturing Methodologies

The electrically functional fibers described herein can be produced using a variety of methods, including both continuous processes and batch type processes. One embodiment of a continuous process is shown schematically in FIG. 8. In process 800 a starting fiber is provided from fiber source 810. The fiber will become the core of the functional fiber and can be a natural or synthetic fiber such as cotton, silk or polyester. Starting fiber 810 need not be conductive, and may also be sacrificial in some embodiments (where it is burned out or otherwise removed after formation of the functional fiber). In some cases, fiber 810 is conductive and may be, for example, a metal or conductive polymer. As fiber 810 is fed via 812 and pulled through initial coating device 820 it can be coated with a first conductive layer, such as a metal or conductive polymer. Suitable coating methods include, for example, chemical vapor deposition (CVD) and atomic layer deposition (ALD). The deposition process can be controlled, for example, by regulating the supply of material being deposited or by adjusting the velocity at which the fiber is advanced through coating device 820. The fiber can be evenly coated for its entire length or the coating thickness can be varied, or even eliminated, for portions of the fiber. If additional layer thickness is needed, the fiber can be passed through coating device 820 one or more additional times via 824. When the first metallic coating is of adequate thickness, the fiber can be passed from coating device 820 to second coating device 830 via 822. Second coating device 830 applies a layer of insulating material (e.g., low-k, high-k, silicon dioxide, etc.) using, for example, CVD or ALD. The coating may be applied evenly along the fiber or portions void of insulator/dielectric material can be left at predetermined intervals, or as otherwise desired. In a later step, the void portions may be coated with an electrically active material, such as a piezoelectric material. Alternatively, the piezoelectric material (or other electrically active material) can be applied in second coating device 830 at the same time as the insulative layer is being applied. For example, second coating device 830 can be programmed to apply alternating portions of insulative material and piezoelectric material in the same layer on the fiber during a single pass. The fiber may take multiple passes through coating device 830 via 834 or can be passed back to first coating device 820 via 836. As will be appreciated in light of this disclosure, the process of FIG. 8 can also be configured to modify the material deposition on the fly to create, for example, alternate layers of high capacitance and low capacitance areas on the fiber, depending on the thickness and/or type of dielectric material used between the conductive layers.

In a further embodiment, second coating device 830 can apply a pre-polymer of, for example, a low-k polymer (or other polymer having a suitable dielectric constant for a given application) by methods such as dipping or spraying. Additives may be included in the pre-polymer to take advantage of the specific surface energy of the first conductive layer so that a desired thickness of pre-polymer is retained on the fiber via surface tension. Portions of the fiber may then be selectively cured by, for example, UV radiation. Uncured portions of pre-polymer may be rinsed, vaporized or otherwise removed from the fiber to produce portions that are void of low-k polymer. These void portions can then be coated, in third coating device 840 via 832, for example, with an electrically functional material such as a ferroelectric polymer. Fiber may be passed through coating device 840 multiple times via 844.

After the third layer of the fiber is complete, the fiber can include, for example, low-k material, electrically functional materials such as piezoelectric materials, or linear portions of each. The fiber may then be pulled through third coating device 840 which can apply a second electrically conductive layer. The methods of application can be the same or different from those used to apply the first conductive layer in coating device 820. As with coating device 820, the fiber may be passed through third coating device 840 one, two, three or more times via 844. In certain embodiments, portions of layer 50 may be built up (not shown) so that the portion extends outward from the core to an extent equal to, or beyond, the expected outer diameter of the outer layer (16 in FIG. 1C). This extended portion can act as a contact for non-integral electronic devices that may be connected to a fiber or functional fabric in a later step. In some embodiments the extended contact portion may extend axially around the fiber or, in additional embodiments, can be more limited and may form a single contact at one specific point on the circumference of the fiber. Devices may be electronically connected to layer 50 (or any other layer including such a contact) by, for example, soldering or thermal bonding.

After the second conductive coating has been applied, the fiber can be passed to coating device 850 from coating device 840 via 842 or directly from coating device 830 via 838. Final coating device 850 can apply an insulative coating such as a polymer. The polymer, for example PVC, may be applied using any suitable conventional method. The polymer may be mixed with textile fibers to provide the coating with the look and feel of a textile fiber. The polymer may include a pigment to provide color or may be translucent or transparent. After the insulative coating has been applied, the coating may be treated in a secondary operation, such as ozone treatment, to render the coating more amenable to dyes that may be applied to the fiber after it has been woven into a fabric.

After the coating has been applied, or at any other point during process 800 the functional fiber can be stored on a spool. After completion, the functional fiber can be passed to weaving device 860 via 852 where it can be incorporated into a fabric along with textile fibers provided by fiber source 870 via 872. The functional fiber can be woven conventionally with textile fibers into an electrically functional fabric or can be made into an electrically functional non-woven fabric. The functional fibers in the fabric may form a circuit and the fabric may also incorporate a microprocessor and/or other functional electronics. Thus, in some embodiments, the fabric can include microprocessors, radiative elements, solar cells, power sources, switches, input devices such as piezoelectric devices and output devices such as piezo luminescent devices. The fabric may be conveyed to coloring apparatus 880 via pathway 862 for dying and/or printing after it has been formed into a fabric in process 860. Alternatively, fibers may be dyed prior to being incorporated into the fabric. In many cases, the electrically functional fabric can be conventionally laundered without damaging the functionality of the fabric.

In embodiments where electronic elements, for example dies, are to be connected to a flexible electronically functional fabric after the fabric is woven, the electronic elements can be attached after weaving by, for example, thermal compression bonding, self-alignment or soldering. In some embodiments, the functional fabrics can be dyed, washed and/or dried after the electronic elements have been attached.

Figure 9:
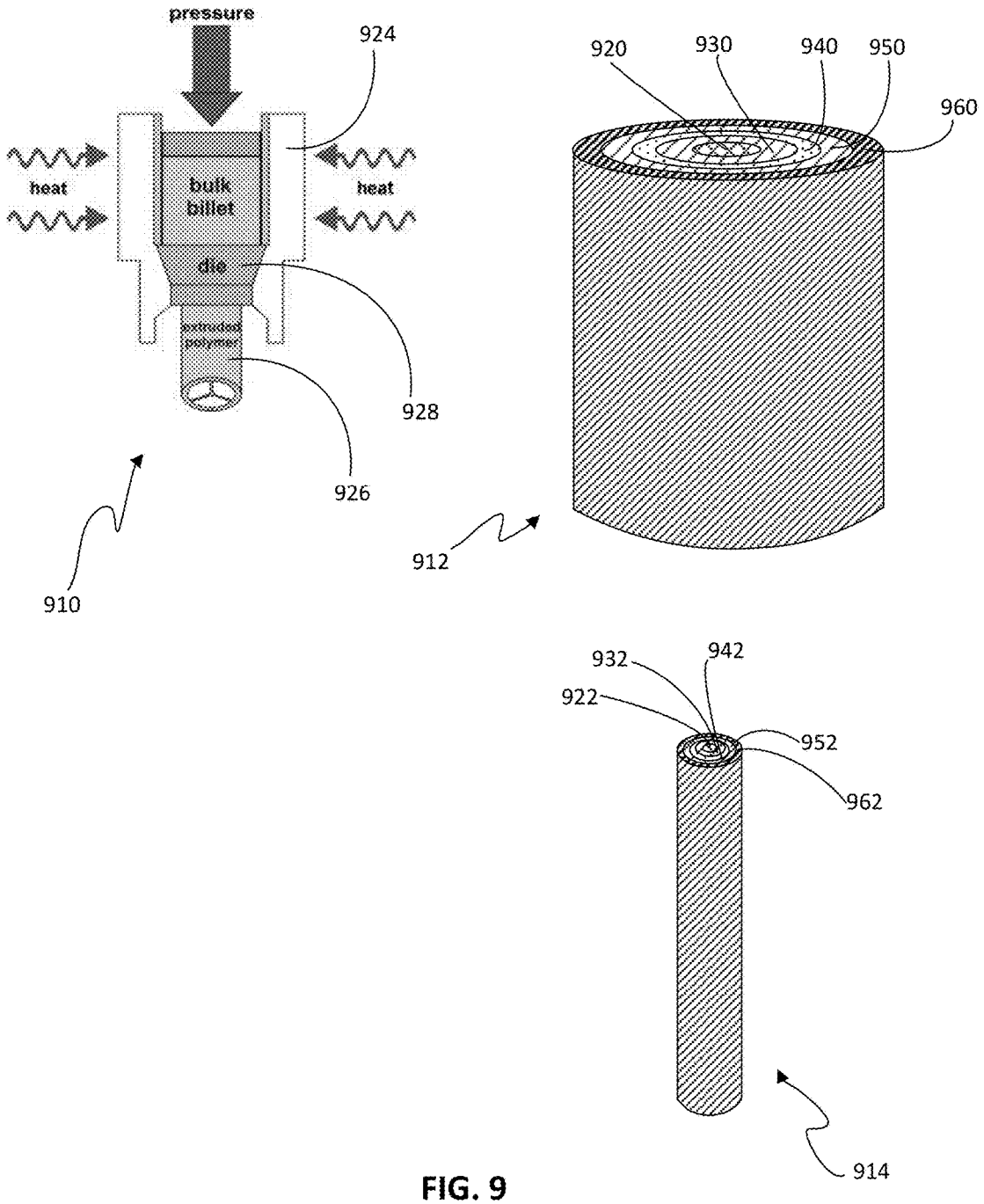
FIG. 9 illustrates another method of fiber production in accordance with an embodiment of the invention.

In another set of embodiments, multi-layered electrically functional fibers can be produced using an extrusion process. FIG. 9 illustrates a process whereby a billet 912 is extruded through extruder 910 to produce a flexible electrically functional fiber 914 with a similar design to that shown in FIG. 1*c*. Billet 912 can include any number of layers. As shown in FIG. 9, billet 912 includes core 920, conductive layer 930, dielectric layer 940, second conductive layer 950 and outer coating layer 960. Billet 912 is placed in extruder 910 where any combination of heat, head pressure and draw pressure can be applied to the billet. As the billet is extruded through die 928, billet 912 becomes a longer and thinner composite 926 while maintaining the same proportional composition of materials that make up billet 912. The corresponding elongated portions of the fiber become core 922, conductive layer 932, dielectric layer 942, conductive layer 952 and outer layer 962. The die may reduce the diameter of the billet by a factor of more than 2, 3, 5, 10, or more. Composite 926 may be drawn through a series of progressively smaller dies until a flexible electrically functional fiber 914 of desired thickness is achieved. For instance, a 1 inch diameter billet may successively be drawn down to a fiber that is less than 10 μm, less than 5 μm, less than 1 μm or less than 100 nm in diameter.

The layers that comprise a particular billet can be of compatible materials that will not flake or separate when forced through the die. For instance, the components of the billet should exhibit similar malleability at the temperature at which the extrusion takes place. In this manner, each layer will deform in a similar manner during the extrusion process, resulting in a fiber in which adjacent layers remain in contact with each other and the thickness of each layer is in proportion to its thickness in the original billet. In one embodiment, all of the layers comprise polymeric materials, and the polymeric materials may exhibit glass transition temperatures that are similar. For instance, each of the materials in the billet may have a glass transition temperature that is within 100° C., within 50° C., or within 20° C. of the glass transition temperature of the other materials comprising the billet. The temperature of the extruder 910 may be optimized for a specific billet and in some instances may be greater than 100° C., greater than 200° C., greater than 300° C. or greater than 400° C. The extruder may also be operated at, or about, the glass transition point of one or more of the components of the billet.

In some embodiments, one or more of the layers can be extruded through die 928 and additional layers may be added using methods such as those described above in reference to the process shown in FIG. 8. For example, a billet may comprise core 920, conductive layer 930, low-k layer 940 and second conductive layer 950. After the billet has been reduced to an appropriately sized fiber a polymer coating layer 960 can be applied using conventional coating techniques. This allows for the inclusion of a softer coating where die extrusion of such a material would not be practical.

Figure 10:
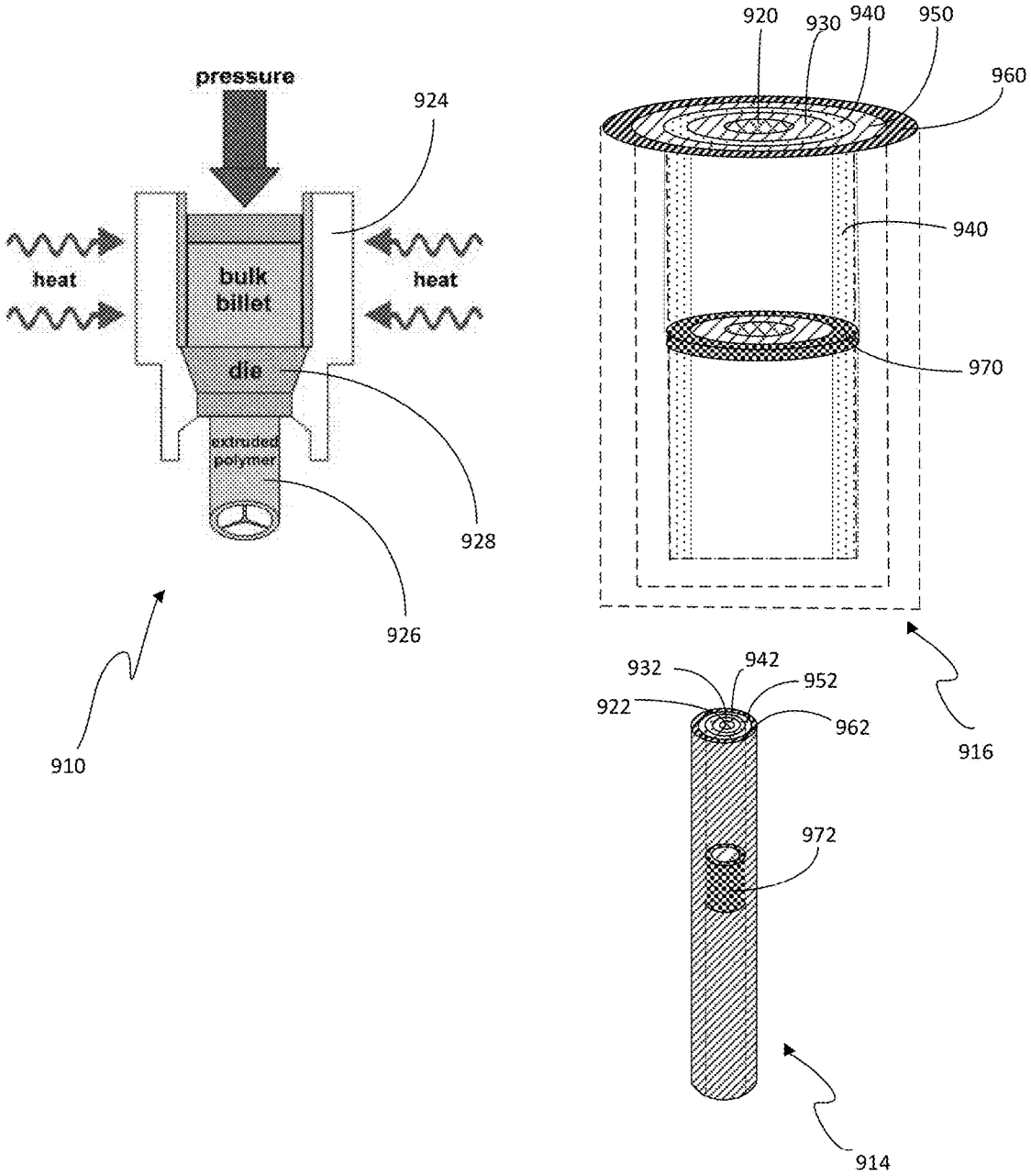
FIG. 10 provides an illustration of another embodiment of fiber production.

FIG. 10 depicts a method of production similar to that shown in FIG. 9 except that one of the layers of the billet, in this specific embodiment the dielectric layer 940, is interrupted by different material. Billet 916 includes core 920, first conductive layer 930, dielectric layer 940, second conductive layer 950 and outer layer 960. In the embodiment shown, the additional material is piezoelectric material 970. When formed in billet 916, the piezoelectric material 970 may be a thin ring shaped disk having an outer diameter and inner diameter substantially equal to that of the insulator layer 940. The piezoelectric material may be, for example, lead zirconate titanate. The resulting electrically functional fiber 914 will include each of the original components in the same ratios but extensively narrowed and elongated. For example, core 920 becomes core 922; conductive layer 930 becomes conductive layer 932; dielectric layer 940 becomes dielectric layer 942; second conductive layer 950 becomes second conductive layer 952; and outer layer 960 becomes second outer layer 962. Lead zirconate titanate insert 970 becomes lead zirconate titanate insert 972 in the same proportion as included in the original billet. Therefore, if the lead zirconate titanate disk 970 is 1% of the height of the billet, then piezoelectric component 972 in functional fiber 914 will form 1% of the total length of the fiber. Additional layers may be inserted into the billet at desired positions and may be the same or different as layer 970. These additional layers, as with lead zirconate titanate disk 970, should be compatible with the other billet materials so that extrusion does not lead to separation or flaking of the material.

The functional fibers described herein may be connected to each other and to other devices and systems to achieve electrical communication therebetween. In some embodiments, functional fibers may be connected in series using an aligned fusion process resulting in connected fibers as shown in FIG. 4. In other embodiments, an end portion of the non-electrical components, e.g., the core and the outer coating can be removed and the remaining electrical components, e.g., the high conductivity layers and low-k layer(s) or other suitable conductive/dielectric configuration, can be bonded together using, for example, heat, pressure, ultrasound or radiation.

Example System

As will be appreciated by those of skill in the art, the flexible fabrics described herein can be integrated with a variety of computing systems. These computing systems may, in some cases, be physically and/or electronically connected to an electronically functional flexible fabric. These computing systems can include a motherboard and the motherboard may include a number of components, including but not limited to a processor and at least one communication chip, each of which can be physically and electrically coupled to the motherboard, or otherwise integrated therein. As will be appreciated, the motherboard may be, for example, any printed circuit board, whether a main board or a daughterboard mounted on a main board or the only board of system, etc. Depending on its applications, the computing system may include one or more other components that may or may not be physically and electrically coupled to the motherboard. These other components may include, but are not limited to, volatile memory (e.g., DRAM), non-volatile memory (e.g., ROM), a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth). Any of the components included in the computing system may include one or more integrated circuits implemented with a low-k dielectric as described herein. In some embodiments, multiple functions can be integrated into one or more chips if so desired (e.g., for instance, note that the communication chips can be part of or otherwise integrated into the processor).

The communication chip enables wireless communications for the transfer of data to and from the computing system. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing system may include a plurality of communication chips. For instance, a first communication chip may be dedicated to shorter range wireless communications such as Wi-Fi and Bluetooth and a second communication chip may be dedicated to longer range wireless communications such as GPS, EDGE, GPRS, CDMA, WiMAX, LTE, Ev-DO, and others.

The processor of the computing system includes an integrated circuit die packaged within the processor. In some embodiments of the present invention, the integrated circuit die of the processor includes one or more transistors or other integrated circuit devices implemented with a fabric based integrated circuit as provided herein. The term "processor" may refer to any device or portion of a device that processes, for instance, electronic data from registers and/or memory to transform that electronic data into other electronic data that may be stored in registers and/or memory.

The communication chip may also include an integrated circuit die packaged within the communication chip. In accordance with some such example embodiments, the integrated circuit die of the communication chip includes one or more transistors or other integrated circuit devices implemented with a low-k dielectric as described herein. As will be appreciated in light of this disclosure, note that multi-standard wireless capability may be integrated directly into the processor (e.g., where functionality of any chips is integrated into processor, rather than having separate communication chips). Further note that processor may be a chip set having such wireless capability. In short, any number of processor and/or communication chips can be used. Likewise, any one chip or chip set can have multiple functions integrated therein.

In various implementations, the computing system may be a laptop, a netbook, a notebook, a smartphone, a tablet, a personal digital assistant (PDA), an ultra-mobile PC, a mobile phone, a desktop computer, a server, a printer, a scanner, a monitor, a set-top box, an entertainment control unit, a digital camera, a portable music player, or a digital video recorder. In further implementations, the system may be any other electronic device that processes data or employs transistor devices or other semiconductor devices that can be implemented with a fabric based system. As will be appreciated in light of this disclosure, various embodiments of the present invention can be used to improve performance on products fabricated at any process node (e.g., in the micron range, or sub-micron and beyond) by incorporating these products into a flexible electrically functional fabric.

In accordance with some of the embodiments disclosed herein, aspects of the invention may include, for instance, one or more of the following elements, in any combination. Any features or ranges provided are not to restrict the scope of various embodiments. A flexible electrically functional woven or non-woven fabric can comprise a plurality of textile fibers and at least one flexible electrically functional fiber capable of at least one of providing energy storage and/or electrical interconnection to an electrical component. A functional fabric can include, for example, a microprocessor, a power source, a switch, a transducer, a light emitting device, a data storage device, a radiative element, a transmitter, a receiver or any combination thereof. The functional fabric can include a flexible electrically functional fiber that comprises a core surrounded by an insulative coating. The flexible fiber can include a plurality of individual electrical elements in an embedding material and may include a core surrounded by a first conductive layer, a dielectric layer, a second conductive layer and an outer coating. The fabric may include a fiber that in turn may include a low-k material, a high-k material, a piezoelectric material, a piezo-luminescent material or any combination thereof and the fiber may have a natural bending radius of less than 1.0 mm. The fabric may include a fiber that comprises a protrusion extending through an outer layer, the protrusion in electrical contact with a computing element.

In one set of embodiments, a functional fabric may exhibit a natural bending radius of less than 5 cm and/or may have a thread count of greater than 50 per square inch. The fabric may include a hybrid thread comprising a flexible electrically functional fiber and a textile fiber. The fabric may comprise a planar phased array, may include conductance shielding and may include a transmitter and receiver. The functional elements of the fabric can include, for example, computing elements selected from organic computing elements and inorganic computing elements. Computing elements may comprise a die, may have a surface area of less than 1 $mm^2$, and the elements may be interconnected to at least one flexible electrically functional fiber. In some embodiments, the functional fabric can include an output device which can be, for example, one or more light emitting elements and/or one or more luminescent fibers. The fabric may also include a microphone and a storage device, for example.

A mobile computing device may comprise any of the fabrics described herein. In other embodiments, the mobile computing device may be a garment that includes one or more of the fabrics described herein.

A method of making a woven electrically functional fabric can include weaving a flexible electrically functional thread with a textile thread to form the electrically functional fabric. The functional thread can be made using atomic layer deposition or chemical vapor deposition or an extrusion technique. The method of making the fabric may also include a step of making a flexible electrically functional thread, and may include a step of operably attaching an electronic element to the fabric. The fabric may be electronically functional at the completion of weaving without any additional steps. Additional steps may be included to manufacture a garment from the functional fabric.

In another set of embodiments, a method of making a computer includes weaving an electronically functional fabric with electrically functional fibers and textile fibers, and operably attaching a microprocessor to the electronically functional fabric. The microprocessor may be connected to contacts on electrically functional fibers woven into the fabric. A plurality of microprocessors may be coordinated to achieve parallel processing.

The foregoing description of example embodiments of the invention has been presented for the purposes of illustration and description. It is not intended to be exhaustive or to limit the invention to the precise forms disclosed. Many modifications and variations are possible in light of this disclosure. It is intended that the scope of the invention be limited not by this detailed description, but rather by the claims appended hereto.

What is claimed is:

1. A flexible electrically functional woven or non-woven fabric comprising:

a plurality of textile fibers; and at least one flexible electrically functional fiber capable of one or both of providing energy storage and electrical interconnection to an electrical component, the at least one flexible electrically functional fiber comprising, for a given cross section, an embedding material, the embedding material being one of a dielectric, piezoelectric, and piezoluminescent material, a plurality of individual electrically functional fibers within the embedding material, such that the embedding material surrounds at least one of the plurality of individually electrically functional fibers, and an insulative layer surrounding the embedding material.

2. The functional fabric of claim 1, wherein the embedding material comprises one or more of porous silicon dioxide, silicon dioxide doped with fluorine, silicon dioxide doped with carbon, hydrogen silsesquioxane (HSQ), methyl silsesquioxane (MSQ), polyimide, polynorbornene, benzocyclobutene, polytetrafluoroethylene (PTFE), and cyclic carbosilane.

3. The functional fabric of claim 1, wherein the embedding material comprises one or more of hafnium oxide, hafnium silicon oxide, nitride hafnium silicate, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate.

4. The functional fabric of claim 1, wherein at least one of the plurality of individual electrically functional fibers comprises one or both of a piezoelectric material and a piezoluminescent material.

5. The functional fabric of claim 1, wherein the insulative layer comprises one or more of polyethylene, polypropylene, polyvinylchloride, PTFE, rayon, nylon, acrylic, polyester, aramid, and silica aerogel.

6. The functional fabric of claim 1 further comprising a planar phased array of radiative elements operably coupled with the at least one flexible electrically functional fiber and configured to one or both of transmit and receive electromagnetic radiation.

7. The functional fabric of claim 6 further comprising conductance shielding for at least a portion of the planar phased array of radiative elements.

8. The functional fabric of claim 6, wherein at least one of the radiative elements is configured to be controlled independently of another of the radiative elements to provide one or both of multidirectional transmitting and multidirectional receiving of electromagnetic radiation.

9. The functional fabric of claim 1 further comprising one or both of an organic computing element and an inorganic computing element operably coupled with the at least one flexible electrically functional fiber.

10. The functional fabric of claim 9, wherein the one or both of an organic computing element and an inorganic computing element is affixed to the functional fabric by one or more of:

a thermal compression bond;

solder; and mating between complementary features of the at least one flexible electrically functional fiber and the at least one of an organic computing element and an inorganic computing element.

11. A flexible display comprising the functional fabric of claim 1, wherein the at least one flexible electrically functional fiber comprises one or both of a light emitting element and a luminescent fiber.

12. The functional fabric of claim 1, wherein the at least one flexible electrically functional fiber further comprises textile fiber twisted therewith.

13. The functional fabric of claim 1 further comprising:

at least one memory; and first and second processors operably coupled with the at least one flexible electrically functional fiber and configured to access the at least one memory, wherein the first and second processors are coordinated to provide parallel processing.

14. A garment comprising:

the functional fabric of claim 1; and at least one integrated circuit die operably coupled with the at least one flexible electrically functional fiber, wherein the at least one integrated circuit die is sized such that flexibility of the functional fabric is maintained at its location.

15. A flexible electrically functional woven or non-woven fabric comprising:

a plurality of textile fibers; and at least one flexible electrically functional fiber capable of one or both of providing energy storage and electrical interconnection to an electrical component, the at least one flexible electrically functional fiber comprising a core portion having a cross-sectional width in the range of 1 nanometer (nm)-100 micrometers (μm), a first conductive and essentially metal layer surrounding the core portion, a dielectric layer surrounding the first conductive layer, a second conductive layer surrounding the dielectric layer, and an insulative layer surrounding the second conductive layer.

16. The functional fabric of claim 15, wherein the core portion comprises one or more of a textile fiber, a liquid, and a gas.

17. The functional fabric of claim 15, wherein the dielectric layer is indirect contact with the first conductive layer or the second conductive layer.

18. The functional fabric of claim 15, wherein one or both of:

one or both of the first and second conductive layers comprises one or more of tin-doped indium-oxide, aluminum-doped zinc-oxide (AZO), indium-doped cadmium-oxide, poly(3,4-ethylenedioxythiophene) (PEDOT), PEDOT with poly(styrene sulfonate) (PSS), and poly(4,4-dioctylcyclopentadithiophene); and the dielectric layer comprises one of one or more of porous silicon dioxide, silicon dioxide doped with fluorine, silicon dioxide doped with carbon, hydrogen silsesquioxane (HSQ), methyl silsesquioxane (MSQ), polyimide, polynorbornene, benzocyclobutene, PTFE, and cyclic carbosilane; and one or more of hafnium oxide, hafnium silicon oxide, nitride hafnium silicate, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate.

19. The functional fabric of claim 15 further comprising a planar phased array of radiative elements operably coupled with the at least one flexible electrically functional fiber and configured to one or both of transmit and receive electromagnetic radiation.

20. The functional fabric of claim 15 further comprising one or both of an organic computing element and an inorganic computing element operably coupled with the at least one flexible electrically functional fiber.

21. The functional fabric of claim 15, wherein the at least one flexible electrically functional fiber further comprises textile fiber twisted therewith.

22. The functional fabric of claim 15 further comprising:

at least one memory; and first and second processors operably coupled with the at least one flexible electrically functional fiber and configured to access the at least one memory, wherein the first and second processors are coordinated to provide parallel processing.

23. A flexible display comprising the functional fabric of claim 15, wherein the at least one flexible electrically functional fiber comprises one or both of a light emitting element and a luminescent fiber.

24. A garment comprising:

the functional fabric of claim 15; and at least one integrated circuit die operably coupled with the at least one flexible electrically functional fiber, wherein the at least one integrated circuit die is sized such that flexibility of the functional fabric is maintained at its location.

25. A method of making a woven electrically functional fabric, the method comprising:

weaving a flexible electrically functional thread with a textile thread to form the electrically functional fabric, wherein the flexible electrically functional thread is capable of providing one or both of energy storage and electrical interconnection to an electrical component, and wherein the flexible electrically functional thread includes A or B, A including, for a given cross section, an embedding material, the embedding material being one of a dielectric, piezoelectric, and piezoluminescent material, a plurality of individual electrically functional threads within the embedding material, such that the embedding material surrounds at least one of the plurality of individually electrically functional threads, and an insulative layer surrounding the embedding material, and B including a core portion having a cross-sectional width in the range of 1 nanometer (nm)-100 micrometers (μm), a first conductive and essentially metal layer surrounding the core portion, a dielectric layer surrounding the first conductive layer, a second conductive layer surrounding the dielectric layer, and an insulative layer surrounding the second conductive layer.

26. The method of claim 25 further comprising:

forming the flexible electrically functional thread by extruding a multi-layer billet through at least one die, wherein the multi-layer billet is configured to maintain proportional composition of its constituent layers upon extrusion.

27. The method of claim 26, wherein the multi-layer billet further comprises a piezoactive component that, upon extrusion through the at least one die, becomes an elongate insert within the flexible electrically functional thread in the same proportion as it was included with respect to the multi-layer billet prior to extrusion thereof.

28. The method of claim 25 further comprising:

forming the flexible electrically functional thread by one or both of atomic layer deposition and chemical vapor deposition.

29. The method of claim 25, wherein the flexible electrically functional thread comprises one or more of:

one or more of porous silicon dioxide, silicon dioxide doped with fluorine, silicon dioxide doped with carbon, hydrogen silsesquioxane (HSQ), methyl silsesquioxane (MSQ), polyimide, polynorbornene, benzocyclobutene, PTFE, and cyclic carbosilane;

one or more of hafnium oxide, hafnium silicon oxide, nitride hafnium silicate, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate; and one or both of a piezoelectric material and a piezoluminescent material.

30. The method of claim 25 further comprising:

forming the flexible electrically functional thread by twisting it with textile fiber.

31. The method of claim 25 further comprising:

operably coupling one or both of an organic computing element and an inorganic computing element with the flexible electrically functional thread.

* * * * *